US010915041B1

(12) United States Patent
Shinozaki et al.

(10) Patent No.: US 10,915,041 B1
(45) Date of Patent: Feb. 9, 2021

(54) POWDER-CONTAINER ATTACHMENT DEVICE, IMAGE FORMING APPARATUS, AND POWDER CONTAINER

(71) Applicant: FUJI XEROX CO., LTD., Tokyo (JP)

(72) Inventors: Seigo Shinozaki, Kanagawa (JP); Hirohisa Hoshino, Kanagawa (JP); Arichika Tanaka, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 16/745,564

(22) Filed: Jan. 17, 2020

(30) Foreign Application Priority Data

Sep. 25, 2019 (JP) ..... 2019-174355

(51) Int. Cl.
*G03G 15/08* (2006.01)

(52) U.S. Cl.
CPC ..... *G03G 15/0886* (2013.01); *G03G 15/0872* (2013.01); *G03G 2215/0872* (2013.01)

(58) Field of Classification Search
CPC ..... G03G 15/0881; G03G 15/0886; G03G 15/0867; G03G 15/087; G03G 15/0872
See application file for complete search history.

(56) References Cited

U.S. PATENT DOCUMENTS 8,244,162 B2 8/2012 Takashima
8,787,803 B2 7/2014 Nakasone
9,442,422 B1 * 9/2016 Terakado ..... G03G 15/0865
2009/0129827 A1 * 5/2009 Ichikawa ..... G03G 15/0886 399/262
2010/0290817 A1 * 11/2010 Takiguchi ..... G03G 15/0872 399/258
2012/0222776 A1 * 9/2012 Sakamoto ..... G03G 15/0879 141/369
2013/0078004 A1 * 3/2013 Matsumoto ..... G03G 15/0886 399/260
2013/0121731 A1 * 5/2013 Takashima ..... G03G 15/0872 399/258
2013/0121732 A1 * 5/2013 Takashima ..... G03G 15/0872 399/258

(Continued)

FOREIGN PATENT DOCUMENTS

JP 2006-091284 A 4/2006
JP 2008-298879 A 12/2008
JP 2012-098501 A 5/2012

*Primary Examiner* — Carla J Therrien
(74) *Attorney, Agent, or Firm* — Sughrue Mion, PLLC

(57) ABSTRACT

A powder-container attachment device includes a powder container that accommodates powder, and a device body. The device body includes an attachment portion to and from which the powder container is attached and removed with a pushing operation and a pull-out operation, a receiving port, a lid that is moved in interconnection with the pushing operation and the pull-out operation to open and close the receiving port, and an engaging portion with which the lid is engaged in the state of closing the receiving port. The powder container includes a protrusion and a disengagement portion. The lid includes a holding portion that removably holds the protrusion, and an engaged portion that is engaged with the engaging portion during the pull-out operation. The powder container is movable in a direction in which the protrusion moves away from the disengagement portion during the pull-out operation.

20 Claims, 13 Drawing Sheets

(56) References Cited

U.S. PATENT DOCUMENTS

| | | | | |
|---|---|---|---|---|
| 2013/0243491 | A1* | 9/2013 | Nodera | G03G 15/0865 399/260 |
| 2014/0064794 | A1* | 3/2014 | Takahashi | G03G 15/0872 399/262 |
| 2015/0043944 | A1* | 2/2015 | Yamamoto | G03G 15/0881 399/258 |
| 2017/0060029 | A1* | 3/2017 | Yomoda | G03G 15/0886 |
| 2017/0115596 | A1* | 4/2017 | Nakajima | G03G 15/0872 |
| 2019/0064696 | A1* | 2/2019 | Katayama | G03G 15/0886 |
| 2019/0339633 | A1* | 11/2019 | Yasuda | G03G 15/0886 |

* cited by examiner 61b
86
86c
82
64B
64d
64e
89B
66a
85
84
63
89A
61d
65A
67A
C1
C2
E2
E1
Z
X
66
83
64A
D1
D2

POWDER-CONTAINER ATTACHMENT DEVICE, IMAGE FORMING APPARATUS, AND POWDER CONTAINER

CROSS-REFERENCE TO RELATED APPLICATIONS

This application is based on and claims priority under 35 USC 119 from Japanese Patent Application No. 2019-174355 filed Sep. 25, 2019.

BACKGROUND

(i) Technical Field

The present disclosure relates to a powder-container attachment device, an image forming apparatus, and a powder container.

(ii) Related Art

For example, Japanese Patent Application Publication No. 2006-91284 (see, for example, claims 1, 5, 6, and 9, and FIGS. 1, 2, and 7 to 12), No. 2008-298879 (see, for example, claim 1 and FIGS. 2 and 5 to 14), and No. 2012-98501 (see, for example, claim 1 and FIGS. 2 to 12) are known as technologies for addressing the defects such as developer leakage that is involved in replacement of, for example, a removably attached cartridge unit or container.

Japanese Patent Application Publication No. 2006-91284 (see, for example, claims 1, 5, 6, and 9, and FIGS. 1, 2, and 7 to 12) describes an image forming apparatus that includes an image carrier, a developing device, a toner cartridge that feeds toner to the developing device, a holder that holds either one or both of the image carrier and the developing device, and an process cartridge removably installed in a body of the image forming apparatus. In Japanese Patent Application Publication No. 2006-91284 (see, for example, claims 1, 5, 6, and 9, and FIGS. 1, 2, and 7 to 12), the holder includes a guide portion along which the toner cartridge slides substantially parallel to the guide portion in the longitudinal direction of the image carrier, and the toner cartridge includes a toner feed port that is opened and closed in interconnection with a sliding operation of the toner cartridge, and a toner-feed-port cap that functions to open or close the toner feed port. The developing device includes a toner receiving port and a toner-receiving-port cap that functions to open or close the toner receiving port. The toner-feed-port cap and the toner-receiving-port cap each have an open-close mechanism that opens and closes in a direction in which the toner cartridge is attached and removed, in interconnection with attachment and removal of the toner cartridge attached to or removed from the developing device in the longitudinal direction. The toner-feed-port cap is moved to open later than the toner-receiving-port cap, and the toner-receiving-port cap is moved to close later than the toner-feed-port cap.

Japanese Patent Application Publication No. 2008-298879 (see, for example, claim 1 and FIGS. 2 and 5 to 14) describes an image forming apparatus that includes a removable-body attaching member, a removable body, and an enclosing portion. The removable-body attaching member includes a body opening through which a developer flows in and a body open-close member that functions to open or close the body opening. The removable-body attaching member is supported by an image forming apparatus body. The removable body is attachable to and removable from the removable-body attaching member. The removable body includes a containing portion, which accommodates a developer, a removable-body opening, which is continuous with the body opening when attached to the removable body to allow the developer in the containing portion to flow into the body opening, and a removable-body open-close member that functions to open or close the removable-body opening. During an attachment or removal of the removable body, the body opening is disposed at the height about the same as that of the removable-body opening in the vertical direction. During attachment of the removable body, the enclosing portion tightly closes a space between a front edge at the front of the removable-body opening in the removable-body attachment direction and the body open-close member, while being held in a state of being compressed between the front edge and the rear end surface of the body open-close member in the removable-body attachment direction.

Japanese Patent Application Publication No. 2012-98501 (see, for example, claim 1 and FIGS. 2 to 12) describes, for example, a developing device that includes a developing device body and a developer cartridge removably attached to the developing device body. Japanese Patent Application Publication No. 2012-98501 (see, for example, claim 1 and FIGS. 2 to 12) describes that the developer cartridge includes a casing member that accommodates a developer, a feed port disposed in the casing member, and a first shutter that functions to open or close the feed port. The developing device body includes a housing that accommodates the developer fed from the developer cartridge, a receiving port disposed in the housing, and a second shutter that operates in interconnection with the first shutter to open or close the receiving port. The first shutter and the second shutter respectively have a first opening and a second opening. The first shutter and the second shutter move in the same movement direction to cause the first opening and the second opening to face the feed port and the receiving port to open the feed port and the receiving port. In the state where the feed port and the receiving port are opened, an end of the second opening in the movement direction is located further frontward of an end of the first opening in the movement direction, and the second shutter is moved to open the receiving port before the first shutter is moved to open the feed port, and is moved to close the receiving port after the first shutter is moved to close the feed port.

SUMMARY

Aspects of non-limiting embodiments of the present disclosure relate to a powder-container attachment device capable of reliably moving a lid to a position at which it closes a receiving port that receives powder fed from a powder container. The lid functions to open or close the receiving port, and is moved in a direction to close the receiving port in interconnection with a removal operation of the powder container. The aspects of non-limiting embodiments of the present disclosure also relate to an image forming apparatus including the attachment device, and to the powder container.

Aspects of certain non-limiting embodiments of the present disclosure address the features discussed above and/or other features not described above. However, aspects of the non-limiting embodiments are not required to address the above features, and aspects of the non-limiting embodiments of the present disclosure may not address features described above.

According to an aspect of the present disclosure, there is provided a powder-container attachment device that includes a powder container that accommodates powder, and a device body. The device body includes an attachment portion to and from which the powder container is attached and removed with a pushing operation and a pull-out operation, a receiving port that receives powder fed from the powder container attached to the attachment portion, a lid that is moved in interconnection with the pushing operation and the pull-out operation of the powder container in an opening direction and a closing direction to open or close the receiving port, and an engaging portion with which the lid is engaged in the state of closing the receiving port.

The powder container includes a protrusion at a portion that is capable of approaching the lid during the pushing operation, and a disengagement portion on the rear of the protrusion. The protrusion faces part of the lid. The disengagement portion disengages the engaging portion.

The lid includes a holding portion that accommodates the protrusion to removably hold the protrusion, and an engaged portion that is engaged with the engaging portion during the pull-out operation and that is elastically deformed with a contact with the disengagement portion during the pushing operation to be disengaged from the engaging portion.

The powder container is movable in a direction in which the protrusion moves away from the disengagement portion during the pull-out operation.

BRIEF DESCRIPTION OF THE DRAWINGS

Exemplary embodiments of the present disclosure will be described in detail based on the following figures, wherein.

DETAILED DESCRIPTION

Hereinbelow, exemplary embodiments of the present disclosure will be described with reference to the drawings.

First Exemplary Embodiment

Figure 1:
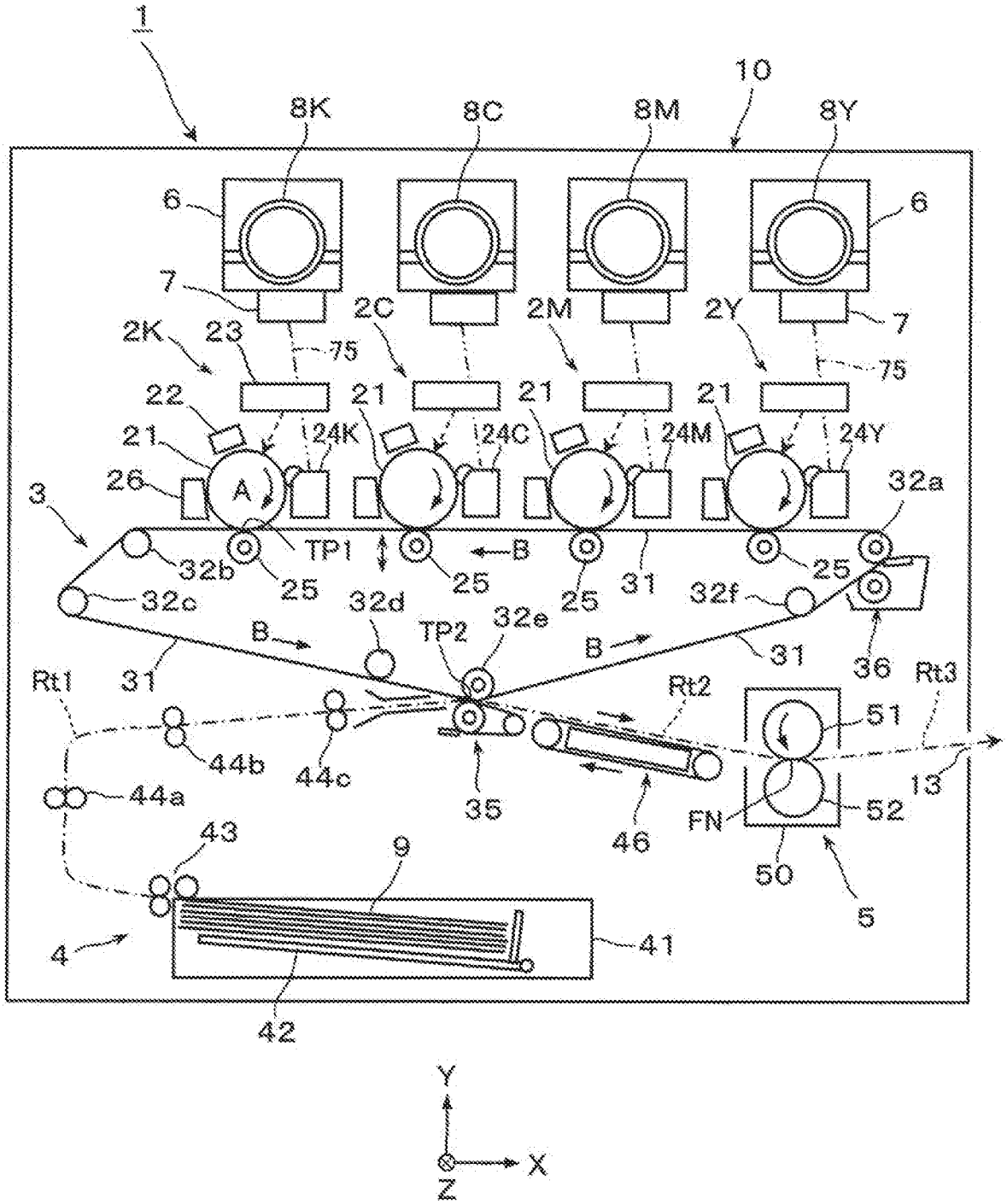
FIG. 1 is a schematic diagram of the entire structure of an image forming apparatus according to a first exemplary embodiment.
Figure 2:
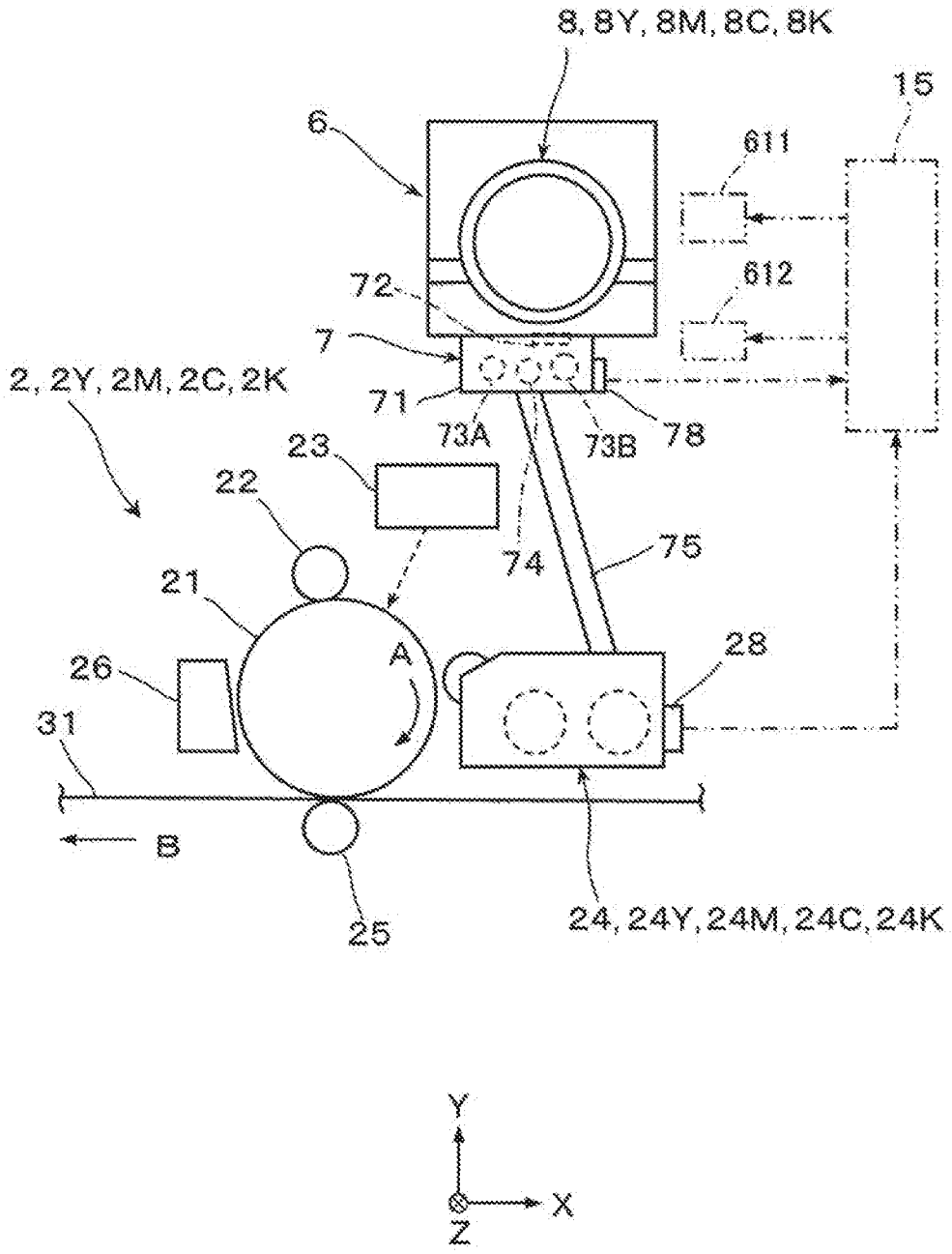
FIG. 2 is a schematic diagram of a structure of a part of the image forming apparatus illustrated in FIG. 1.

FIG. 1 and FIG. 2 illustrate an image forming apparatus 1 according to a first exemplary embodiment of the present disclosure. FIG. 1 illustrates the entire structure of the image forming apparatus 1. FIG. 2 illustrates the structure of part (such as an image forming apparatus, an attachment device of a developer container, or a supply device) of the image forming apparatus 1.

Arrows denoted with reference signs X, Y, and Z in the drawings including FIG. 1 respectively denote the width direction, height direction, and depth direction in a three-dimensional space assumed in each drawing. A circle at the junction of the X and Y (or Y and Z) direction arrows in each drawing denotes that the Z (or X) direction is directed downward in the drawing.

Structure of Image Forming Apparatus

The image forming apparatus 1 is an apparatus that forms an image from toner, serving as a developer, on a sheet 9, which is an example of a recording medium. The image forming apparatus 1 according to the first exemplary embodiment is, for example, a printer that forms images corresponding to image information input from an external connection device such as an information terminal.

As illustrated in FIG. 1, the image forming apparatus 1 includes a housing 10 having a predetermined profile. The image forming apparatus 1 includes, inside the housing 10, image forming devices 2, which form toner images based on image information, an intermediate transfer device 3, which temporarily holds and transports toner images formed by the image forming devices 2 and then second-transfers the toner images to sheets 9, a sheet feeder 4, which accommodates the sheets 9 and feeds the sheets 9 to a second-transfer position of the intermediate transfer device 3, and a fixing device 5, which fixes the toner images second-transferred by the intermediate transfer device 3 to the sheets 9.

Here, the image information is information relating to images such as characters, figures, photographs, and patterns. The housing 10 is a structure having a predetermined shape and formed from any of various types of support members and covering materials. Dot-and-dash lines attached with an arrow illustrated in FIG. 1 and other drawings indicate a substantial transport path in the housing 10 along which the sheets 9 are transported.

The image forming devices 2 include four image forming devices 2Y, 2M, 2C, and 2K, which respectively form toner images of four colors of yellow (Y), magenta (M), cyan (C), and black (K).

Each of the four image forming devices 2 (2Y, 2M, 2C, and 2K) includes a photoconductor drum 21, which is an example of an image carrier that rotates in the direction of arrow A, and devices around the photoconductor drum 21, such as a charging device 22, an exposure device 23, a developing device 24 (24Y, 24M, 24C, or 24K), a first-transfer device 25, and a drum cleaner 26. In FIG. 1, the devices 21 to 26 of the image forming device 2K are denoted with reference signs, and not all the devices 21 to 26 of the image forming device 2 (2Y, 2M, or 2C) for another color are denoted with reference signs.

Each charging device 22 is a device that charges the outer circumferential surface (image receivable surface) of the corresponding photoconductor drum 21 with electricity of a predetermined surface potential. Each exposure device 23 is a device that exposes the outer circumferential surface of the photoconductor drum 21 to light based on the image information to form an electrostatic latent image for a predetermined color component (Y, M, C, or K). Each developing device 24 (Y, M, C, or K) is a device that develops an electrostatic latent image formed on the outer circumferential surface of the corresponding photoconductor drum 21 with a developer (toner) for the predetermined color Y, M, C, or K into a toner image of the corresponding one of the four colors.

The first-transfer device 25 is a device that electrostatically transfers, to the intermediate transfer device 3 (intermediate transfer belt 31), the toner image of the corresponding color formed on the outer circumferential surface of the photoconductor drum 21. The drum cleaner 26 is a device that scratches unwanted matter, such as unwanted toner or paper dust, adhering to the outer circumferential surface of the photoconductor drum 21 off for removal to clean the outer circumferential surface of the photoconductor drum 21.

In each of these image forming devices 2 (2Y, 2M, 2C, and 2K), a portion at which the photoconductor drum 21 (strictly speaking, the intermediate transfer belt 31 of the intermediate transfer device 3) and the first-transfer devices 25 face each other serves as a first transfer position TP1 at which a toner image is first-transferred.

When, for example, receiving an instruction of performing an image forming operation for forming a multi-color image, that is, a full-color image, by combining toner images of the four colors (Y, M, C, and K), each of the four image forming devices 2Y, 2M, 2C, and 2K performs, on the corresponding photoconductor drum 21 that rotates in the direction of arrow A, a charging operation with the corresponding charging device 22, an exposure operation with the corresponding exposure device 23, and a developing operation with the corresponding developing device 24 (Y, M, C, or K).

Thus, toner images of four colors formed from components of four colors (Y, M, C, and K) are separately formed on the photoconductor drums 21 of the image forming devices 2Y, 2M, 2C, and 2K. Subsequently, the toner images of four colors formed on the respective photoconductor drums 21 are transported to the respective first transfer positions TP1 with rotation of the photoconductor drums 21.

The intermediate transfer device 3 is a device that holds, through first transfer, the toner images of the respective colors formed by the image forming devices 2 (2Y, 2M, 2C, and 2K), and then transports the toner images to a position at which the toner images are second-transferred to a sheet 9. The intermediate transfer device 3 is disposed in the housing 10 below the image forming devices 2 (2Y, 2M, 2C, and 2K).

The intermediate transfer device 3 includes an intermediate transfer belt 31 that receives and holds the toner images first-transferred from the respective photoconductor drums 21 of the image forming devices 2 (2Y, 2M, 2C, and 2K). The intermediate transfer belt 31 is supported by multiple support rollers 32*a* to 32*f* disposed inside the intermediate transfer belt 31 to rotate (rotationally move) in the direction of arrow B while sequentially passing the first transfer positions of the image forming devices 2 (2Y, 2M, 2C, and 2K).

The support roller 32*a* serves as a driving roller that receives rotation power from a driving device, not illustrated, to rotate. The support roller 32*b* serves as a retaining roller that holds, in cooperation with the support roller 32*a*, the position (level) of the belt that passes the first transfer positions of the intermediate transfer belt 31. The support roller 32*c* serves as a tension roller.

The support roller 32*d* serves as a retaining roller for the intermediate transfer belt 31 prior to second transfer. The support roller 32*e* serves as a second-transfer back-up roller. The support roller 32*f* serves as a retaining roller for the intermediate transfer belt 31 after the intermediate transfer belt 31 passes the second-transfer position. When the support roller 32*e* serves as a roller that receives a second-transfer voltage, the support roller 32*e* receives a second-transfer voltage from a power feeder, not illustrated.

On the inner side of the intermediate transfer belt 31, the first-transfer devices 25 of the respective image forming devices 2 (2Y, 2M, 2C, and 2K) are disposed. The first-transfer devices 25 also constitute part of the intermediate transfer device 3. The first-transfer devices 25 include, for example, first-transfer rollers. The first-transfer rollers receive first-transfer current from a power feeder, not illustrated.

At a portion on the outer circumferential surface of the intermediate transfer belt 31 supported by the support roller 32*e*, a second-transfer device 35 is disposed. The second-transfer device 35 allows the sheets 9 to pass thereby, and second-transfers the toner images on the intermediate transfer belt 31 to the sheets 9. The second-transfer device 35 includes, for example, a second-transfer roller.

At a portion on the outer circumferential surface of the intermediate transfer belt 31 supported by the support roller 32*a*, a belt cleaner 36 is disposed. The belt cleaner 36 removes unwanted matter such as unwanted toner remaining of the outer circumferential surface of the intermediate transfer belt 31 after second transfer to clean the outer circumferential surface of the intermediate transfer belt 31.

In the intermediate transfer device 3, the portion of the outer circumferential surface of the intermediate transfer belt 31 with which the second-transfer device 35 is in contact serves as a second-transfer position TP2 at which the toner image is second-transferred.

The sheet feeder 4 is a device that accommodates and feeds the sheets 9 to be fed to the second-transfer position TP2 of the intermediate transfer device 3. The sheet feeder 4 is disposed in the housing 10 below the image forming devices 2 (2Y, 2M, 2C, and 2K).

The sheet feeder 4 includes devices including a sheet container 41 and a feeding device 43.

The container 41 is a container member that includes a receiving board 42, which allows multiple sheets 9 to be loaded thereon in a predetermined orientation. The container 41 is attached to be drawable to the outside of the housing 10 for, for example, replenishment of sheets 9. The feeding device 43 is a device that picks up the sheets 9 loaded on the receiving board 42 of the container 41 one by one with a feeding device such as multiple rollers.

The sheets 9 may be recording media formed from any material and having any form as long as they are transportable in the housing 10 and allow transfer or fixing of toner images thereto, such as ordinary paper sheets, coated paper sheets, or thick paper sheets.

Between the sheet feeder 4 and the second-transfer position TP2 of the intermediate transfer device 3, a paper-feed transport path Rt1, along which the sheets 9 in the sheet feeder 4 are transported to the second-transfer position TP2, is disposed. This paper-feed transport path Rt1 includes multiple transport rollers 44*a* to 44*c*, which hold the sheets 9 therebetween to transport the sheets 9, and multiple guide members, not illustrated, that secure the transport space for the sheets 9 and guide the sheets 9 during transportation.

In the intermediate transfer device 3, the toner images of four colors formed on the photoconductor drums 21 of the image forming devices 2 (2Y, 2M, 2C, and 2K) are first-transferred by the first-transfer devices 25 to be sequentially stacked one on another on the outer circumferential surface of the intermediate transfer belt 31 rotating in the direction of arrow B, and then transported to the second-transfer position TP2. At the timing of formation and transportation of the toner images, an intended sheet 9 is fed from the sheet feeder 4 and transported to the second-transfer position TP2 along the paper-feed transport path Rt1.

Thus, at the second-transfer position TP2 of the intermediate transfer device 3, the toner images first-transferred to and transported by the intermediate transfer belt 31 are collectively second-transferred to one surface of the sheet 9 with a transfer effect of the second-transfer device 35.

The fixing device 5 is a device that fixes the toner image second-transferred by the intermediate transfer device 3 to the sheet 9. The fixing device 5 is disposed in the housing 10 at a lower portion on the downstream side of the second-transfer position TP2 of the intermediate transfer device 3 in the transport direction of the sheets 9.

The fixing device 5 includes devices such as a heating rotator 51 and a pressing rotator 52, in an internal space of a housing 50 having an inlet port or an outlet port for the sheets 9.

The heating rotator 51 is a rotator having a roller form or a belt-pad form that rotates in the direction indicated by an arrow, and has its outer surface retained at a predetermined temperature by a heating member, not illustrated. The pressing rotator 52 is a rotator having a roller form or a belt-pad form that is in contact with the heating rotator 51 with a predetermined pressure to rotate following the rotation of the heating rotator 51. The pressing rotator 52 may be heated with a heating member.

A portion of the fixing device 5 at which the heating rotator 51 and the pressing rotator 52 come into contact with each other serves as a nip portion (fixing unit) FN, which performs operations such as heating or pressing for fixing an unfixed toner image onto the sheet 9.

Between the fixing device 5 and the second-transfer position TP2 of the intermediate transfer device 3, a relay transport path Rt2 is disposed. The relay transport path relays and transports the second-transferred sheet 9 to the fixing device 5. The relay transport path Rt2 includes, for example, a suction belt-transport device 46.

Between the fixing device 5 and an outlet port 13, a discharge transport path Rt3 is disposed. The discharge transport path Rt3 transports the sheet 9 subjected to the fixing operation to the outlet port 13 of the housing 10 to discharge the sheet 9 to a discharge container, not illustrated. The discharge transport path Rt3 includes a pair of transport rollers, a discharge roller, and multiple guide members that guide the sheets 9, which are not illustrated.

In the fixing device 5, the sheet 9 undergoing second transfer at the second-transfer device 35 is introduced into the fixing unit of the fixing device 5 along the relay transport path Rt2.

Thus, the sheet 9 undergoes the fixing operation from the fixing device 5 to have the toner image fixed thereto, so that a full-color image is formed on one surface of the sheet 9. Finally, the sheet 9 that has undergone fixing is discharged to a discharge container, not illustrated, along the discharge transport path Rt3.

In the image forming apparatus 1, a single sheet 9 having a full-color image formed thereon is output through the above operation. The image forming apparatus 1 is capable of forming a single-color image such as a monochrome image.

Structure of Developer Container or Attachment Device for Developer Container

In the image forming apparatus 1, as illustrated in FIG. 1 or FIG. 2, the developing devices 24 (24Y, 24M, 24C, and 24K) of the image forming devices 2 (2Y, 2M, 2C, and 2K) are respectively replenished with a predetermined amount of developers of the corresponding colors from developer containers 8Y, 8M, 8C, and 8K, which accommodate developers of different colors as an example of powder.

Developer containers 8 (8Y, 8M, 8C, and 8K) are replaceable cartridge containers, and are removably attached to an attachment device 6 for use. When the developing devices 24 use a binary developer, each developer container 8 (8Y, 8M, 8C, or 8K) accommodates, as a developer, toner of one of four colors (Y, M, C, and K) or toner of an individual color containing a small amount of a carrier.

The developing devices 24 (24Y, 24M, 24C, and 24K) are replenished with developers accommodated in the developer containers 8 via supply devices 7 individually disposed below the attachment devices 6. Reference signs 75 in FIG. 1 and FIG. 2 denote replenishment carrier pipes that transport the developers fed from the corresponding supply devices 7 to the developing devices 24 (24Y, 24M, 24C, and 24K).

As illustrated in FIG. 2, each supply device 7 includes a housing 71 having a reception port 72, which receives a developer fed from the corresponding developer container 8 via the corresponding attachment device 6, on the upper surface. Inside the housing 71, the developer is circularly transported by two rotating transport members 73A and 73B, which are arranged parallel, and the developer inside the housing 71 is fed toward the developing device 24 by a transport member 74 that is disposed between the transport members 73A and 73B and that rotates at predetermined timing.

Here, as illustrated in FIG. 2, the operation of replenishing the developing device 24 with the developer is performed in the following manner. The amount of a developer (for example, an amount of toner in the case of a binary developer) accommodated in the developing device 24 is detected by a detection member 28. When a controller 15 that has received detection information determines that the toner runs short, the controller 15 controls devices such as a motor 612 that rotates the transport member 74 for a predetermined period of time to drive such devices.

The developer is also fed to each supply device 7 from the corresponding developer container 8. The operation of feeding the developer to the supply device 7 is performed in the following manner. The amount of a developer accommodated in the housing 71 of the supply device 7 is detected by a detection member 78, and the detection information is transmitted to the controller 15. Upon receipt of the detection information, the controller 15 controls devices such as a transport member that transports the developer in the developer container 8 or a motor 611 that rotates the container itself for a predetermined time period to drive such devices.

Structure of Developer Container

Figure 3:
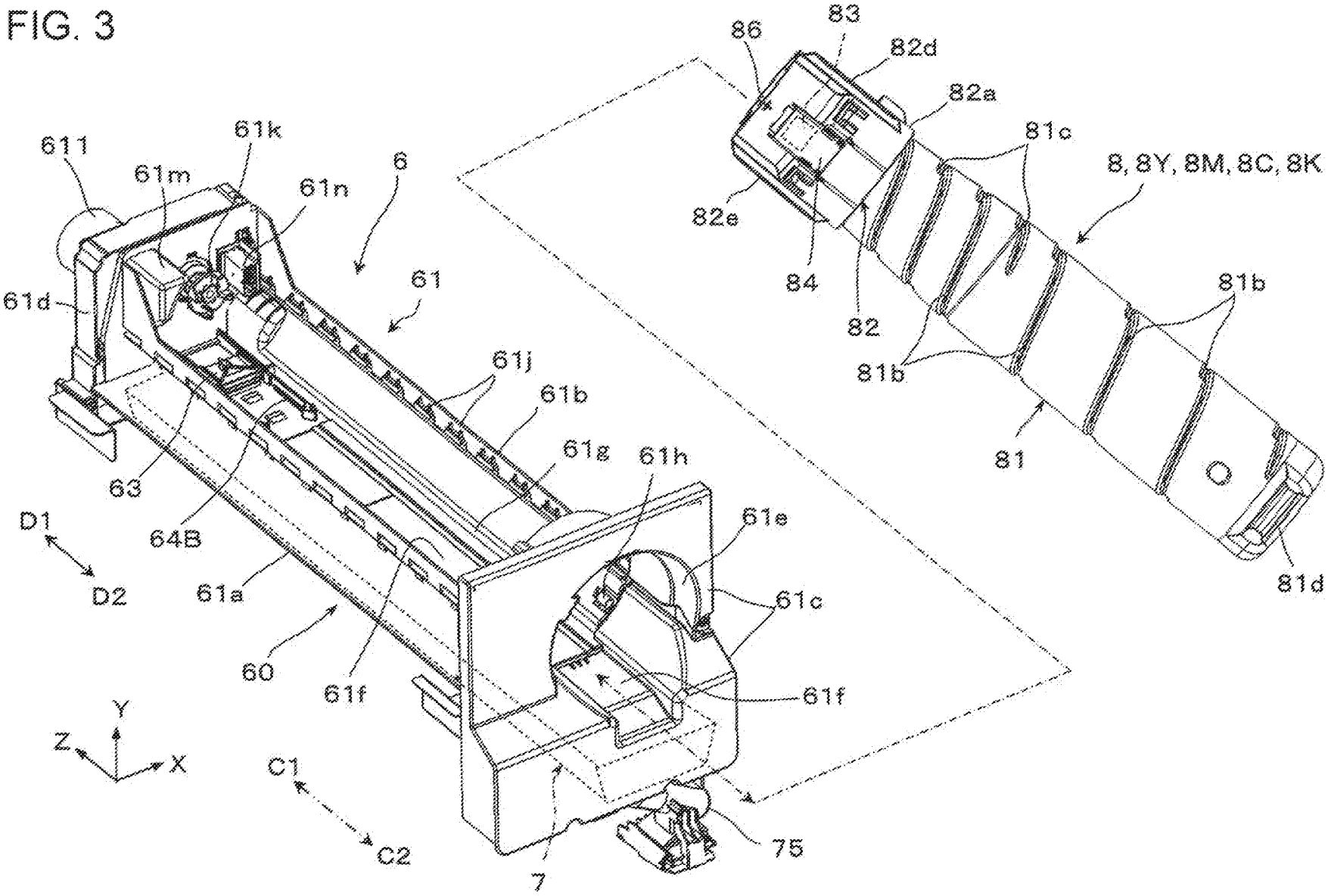
FIG. 3 is a schematic perspective view of a developer container and an attachment device for the developer container.
Figure 5:
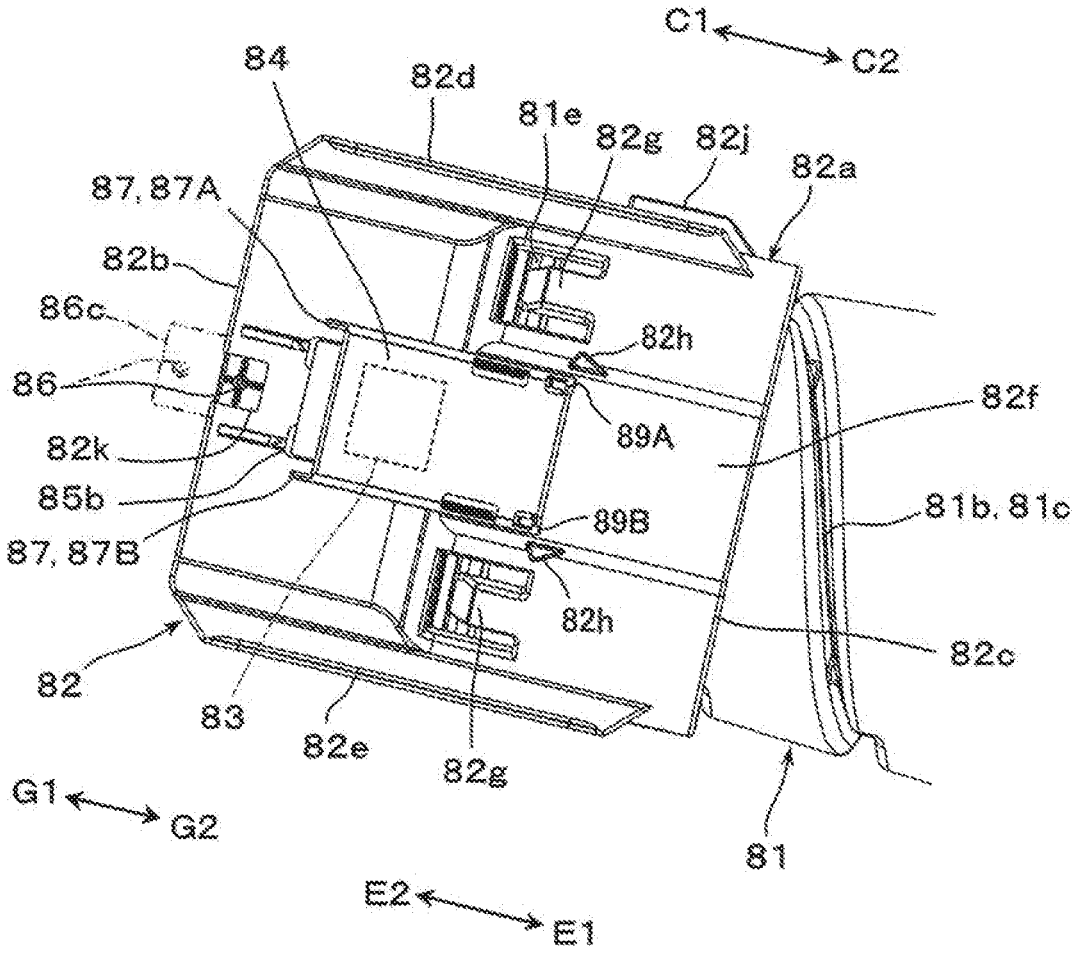
FIG. 5 is a perspective view of part of the developer container illustrated in FIG. 3, viewed from the bottom.

As illustrated in FIG. 3 or FIG. 5, the developer containers 8 (8Y, 8M, 8C, and 8K) each include a cylindrical container body 81 and an end-portion holder 82, which rotatably holds the far-side end of the container body 81 in the longitudinal direction.

The container body 81 has a rectangular outlet port, not illustrated, at the far-side end (end to which the end-portion holder 82 is attached) in the longitudinal direction. The outlet port allows the accommodated developer to be discharged therethrough. On the outer circumferential surface of the container body 81, helical grooves 81*b* and 81*c* pitched at the same interval are alternately disposed to be staggered in the middle without interfering with each other. Inside the container body 81, the helical grooves 81*b* and 81*c* protrude helically to function as transport protrusions for transporting the accommodated developer toward the outlet port when the container body 81 rotates in a fixed direction. The container body 81 also has a handle portion 81*d*, which has a recessed shape to allow a user to hold with his/her hand, at the near-side end in the longitudinal direction.

The end-portion holder 82 is formed from a substantially cylindrical tube with one open end.

The end-portion holder 82 has, at the portion corresponding to the outlet port of the container body 81 not illustrated, an opening 83 having substantially the same size and shape as those of the outlet port.

The end-portion holder 82 includes a container lid 84, which functions to open or close the opening 83. The container lid 84 is a rectangular plate member. The container lid 84 is slidably attached to the end-portion holder 82 to be moved in an opening direction E1 and a closing direction E2 in interconnection with the pushing operation and the pull-out operation of the developer container 8 to open or close the opening 83. The reference sign 82*f* in FIG. 5 denotes a portion of the end-portion holder 82 formed from a substantially flat bottom surface in which the opening 83 is formed. The container lid 84 is a portion that moves to open the opening 83.

Guided protrusions 82*d* and 82*e* are disposed on both sides of the container lid 84 of the end-portion holder 82. The guided protrusions 82*d* and 82*e* are guided while the developer container 8 is moving for removal or attachment. The guided protrusions 82*d* and 82*e* are protrusions that extend linearly in the direction in which the developer container 8 moves for removal or attachment. The reference signs 82*g* in FIG. 5 denote fixing pieces for fixing the end-portion holder 82 to the container body 81. The fixing pieces 82*g* are snap-fit pieces shaped to be engaged on an attachment groove 81*e* extending in the circumferential direction on the outer circumferential surface at the far-side end of the container body 81.

As illustrated in FIG. 3, FIG. 5, and other drawings, the developer containers 8 (8Y, 8M, 8C, and 8K) each include a protrusion 86 and disengagement portions 87A and 87B. The protrusion 86 is disposed at a portion that is capable of approaching a lid 63 of the attachment device 6 during the pushing operation for attachment to the attachment device 6, and faces a portion of the lid 63 (holding portion 66, described below). The disengagement portions 87A and 87B disengage engaged portions 67A and 67B of the lid 63, described below, at the rear of the protrusion 86.

The protrusion 86 exerts an effect of moving the lid 63 of the attachment device 6 in substantially a closing direction D2.

As illustrated in FIG. 5, FIGS. 7A and 7B, FIG. 9, and other drawings, the protrusion 86 is disposed at the bottom of the developer container 8 near a far-side end 82*b* of the end-portion holder 82 to protrude by a predetermined length downward (for example, in the direction of gravity) while the developer container 8 is attached for use. The protrusion 86 is formed from, for example, a cylindrical protrusion.

As illustrated in, for example, FIG. 5 to FIG. 7B and other drawings, the disengagement portions 87A and 87B are pieces that protrude from far-side end corners of the container lid 84 of the developer container 8 by a predetermined length in movement directions C1 and C2 in which the developer container 8 moves for removal or attachment.

The disengagement portions 87A and 87B have their protruding ends elastically deformable to bend the engaged portions 67A and 67B outward to the left and right (refer to the state illustrated in FIG. 13) when coming into contact with the engaged portions 67A and 67B of the lid 63, described below.

Structure of Attachment Device of Developer Container

The attachment devices 6 of the developer containers 8 for the four colors have substantially the same structure.

Figure 4A:
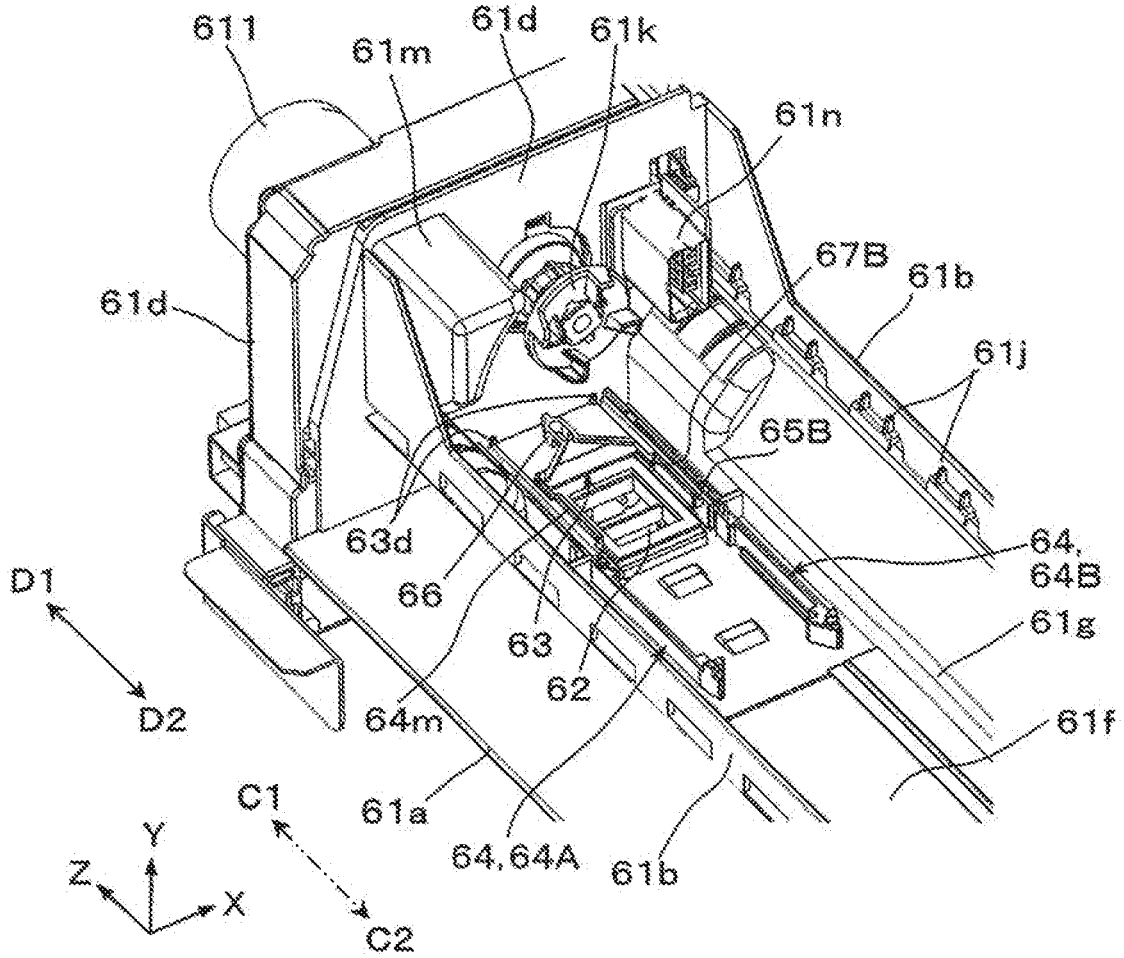
FIG. 4A is an enlarged perspective view of a state (the state where the lid is positioned to open the receiving port) of part of the attachment device illustrated in FIG. 3.
Figure 4B:
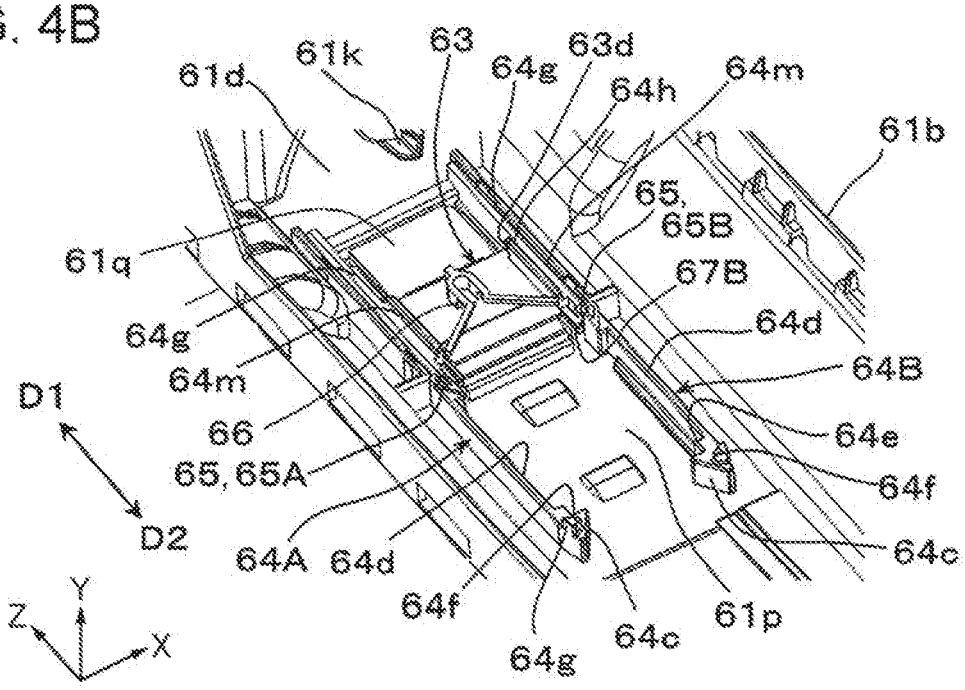
FIG. 4B is an enlarged perspective view of another state (the state where the lid is positioned to close the receiving port) of part of the attachment device illustrated in FIG. 3.

As illustrated in, for example, FIG. 3, FIGS. 4A and 4B, and other drawings, each attachment device 6 includes a device body 60, which includes an attachment portion 61, a receiving port 62, the lid 63, and an engaging portion 65. The attachment portion 61 allows the developer container 8 to be attached thereto or removed therefrom with the pushing operation and the pull-out operation. The receiving port 62 receives a developer fed from the developer container 8 attached to the attachment portion 61. The lid 63 is moved in an opening direction D1 or a closing direction D2 in interconnection with the pushing operation or the pull-out operation of the developer container 8 to open or close the receiving port 62. The engaging portion 65 allows the lid 63 to be engaged therewith when the receiving port 62 is closed.

In FIG. 3 and other drawings, arrow C1 denotes the direction in which the developer container 8 moves in the pushing operation, and arrow C2 denotes the direction in which the developer container 8 moves in the pull-out operation.

The attachment portion 61 is a structure that includes a unidirectionally elongated flat base 61*a*, attachment frames 61*b* disposed on the base 61*a* and each having a cross section that has a groove shape of bending substantially downward, and a side wall portion 61*c* and a side wall portion 61*d*, disposed on both ends of the base 61*a* and the attachment frames 61*b* in the longitudinal direction (direction substantially parallel to the direction denoted with arrow Z). The side wall portion 61*c* is disposed on the near side and the side wall portion 61*d* is disposed on the far side.

As illustrated in FIG. 4A, the receiving port 62, which is a rectangular opening, is disposed near the far-side end (side denoted with arrow Z) of the base 61*a* and the attachment frames 61*b* in the longitudinal direction. The receiving port 62 extends through the base 61*a* and the attachment frames 61*b*.

The side wall portion 61*c* on the near side (the side opposite to the side denoted with arrow Z) in the longitudinal direction has an attachment guide port 61*e*, which allows the developer container 8 to pass therethrough for removal or attachment. In the bottom of the side wall portion 61*c* and the attachment frames 61*b*, a passage recess 61*f* is formed. The passage recess 61*f* extends linearly and continuously in the longitudinal direction to allow the container lid 84 of the developer container 8 to pass therethrough without touching the passage recess 61*f*.

At the portions on the left and right side surfaces of the attachment frames 61*b* above the passage recess 61*f*, linear guide steps (guide rails) 61*g* are disposed. The guide steps 61*g* guide the developer container 8 in the direction in which the developer container 8 moves during the pushing operation or the pull-out operation. The guided protrusions 82*d* and 82*e* of the end-portion holder 82 of the developer container 8 are slidably guided while being placed on the guide steps 61*g*.

Multiple studded support portions 61*j* are arranged at predetermined intervals on left and right side portions above the passage recess 61*f*, near the upper ends of the left and right side surfaces of the attachment frame 61*b*. The studded support portions 61*j* keep the orientation and the position of the developer container 8 (vertical and lateral positions of the developer container 8 with respect to the attachment device 6 in the movement directions C1 and C2) to a predetermined state when the guided protrusions 82*d* and 82*e* pass while being in contact with the studded support portions 61*j* during removal or attachment of the developer container 8. At the ends of the attachment frames 61*b* adjacent to the side wall portion 61*c* on the near side, rotation support portions 61*h* are disposed. Each rotation support portion 61*h* includes a roller that rotatably supports the container body 81 of the developer container 8.

At the side wall portion 61*d* on the far side, a coupling 61*k* is disposed. The coupling 61*k* is removably coupled with a coupling at the far-side end of the container body 81 of the developer container 8, not illustrated, to transmit rotation power.

The reference sign 611 illustrated in FIG. 3, FIG. 4, and other drawings denotes a motor that generates rotation power to be transmitted to the coupling 61*k*. The reference sign 61*m* denotes a stationary holding portion that fixes and holds the end-portion holder 82 of the attached developer container 8. The reference sign 61*n* denotes a connection terminal (connector) that is coupled to a storage, such as a memory, included in the end-portion holder 82 of the developer container 8.

As illustrated in FIG. 4, FIG. 6, and other drawings, a pair of left and right guide support members 64A and 64B are disposed at the bottom portions of the attachment frames 61*b* on the far side. The guide support members 64A and 64B guide and support the lid 63 and the container lid 84 while they are moving. The guide support members 64A and 64B are disposed on the left and right sides of the receiving port 62 to constitute part of the passage recess 61*f* on the far side.

The guide support members 64A and 64B each include an introduction guide portion 64*c* at the end on the near side. The introduction guide portions 64*c* have surfaces inclined inward toward each other.

The guide support members 64A and 64B each include an accommodating holding portion 64*d* at a portion continuous with the introduction guide portion 64*c* on the far side. When the container lid 84 is positioned to close the outlet port of the developer container 8, the left and right ends of the container lid 84 are held still while being accommodated in the accommodating holding portions 64*d*. The accommodating holding portions 64*d* are recessed to the left and right sides. The ends of the accommodating holding portions 64*d* on the near side serve as end engagement portions 64*e* with which corners 89A and 89B of the container lid 84 on the near side are removably engaged.

The guide support members 64A and 64B include a pair of left and right support portions 64*f* at far-side portions of the accommodating holding portion 64*d*. The support portions 64*f* support and guide the left and right ends of the lid 63 while the lid 63 is moving in the opening direction D1 and the closing direction D2.

The pair of left and right support portions 64*f* include lower support portions, which support and guide the lower portions of the left and right ends of the lid 63, and upper support portions 64*m*, which hold and guide the upper portions of the left and right ends of the lid 63.

The lower support portions are steps linearly continuous from the entire areas of the support portions 64*f* from the ends on the near side to the ends on the far side. The upper support portions 64*m* serve as opposing surface portions that extend in a section from the ends of the support portions 64*f* on the near side to middle portions on the far side, and face the lower support portions while being spaced apart above by a predetermined distance in parallel with the lower support portions.

The ends of the upper support portions on the near side serve as the engaging portions 65 that allow the lid 63 to be engaged therewith when the lid 63 is positioned to close the receiving port 62. In the first exemplary embodiment, as illustrated in FIG. 4, FIG. 6, and other drawings, the engaging portions 65 are a pair of left and right engaging portions 65A and 65B. The engaging portions 65A and 65B serve as surfaces with which hook portions of engaged portions 67 of the lid 63, described below, are engaged.

An end 64*h* of each upper support portion on the far side serves as a stopper that causes the lid 63 to stop (controls the movement of a stop protrusion 63*d*, described below) at an intended position while the lid 63 is moving to close the receiving port 62.

As illustrated in FIG. 4B, a portion of the bottom interposed between the near-side portions of the pair of left and right guide support members 64A and 64B of the attachment frames 61*b* serves as a stop area 61*p* that causes the container lid 84 to stop at the position where the outlet port of the developer container 8 is opened. As illustrated in FIG. 4B, a portion of the bottom interposed between the far-side portions of the pair of left and right guide support members 64A and 64B of the attachment frames 61*b* serves as a stop area 61*q* that causes the lid 63 to stop at the position where the receiving port 62 of the device body 60 is opened.

Subsequently, as illustrated in FIG. 4, FIG. 6, and other drawings, the lid 63 is formed from a flat, substantially rectangular plate member having such a size as to cover the receiving port 62.

As illustrated in FIG. 3, FIG. 4, FIG. 6, and other drawings, the lid 63 is attached to be movably guided in the opening direction D1 to open the receiving port 62 and the closing direction D2 to close the receiving port 62 while having its left and right ends supported by the pair of left and right support portions 64*g* of the guide support members 64A and 64B.

The lid 63 includes a holding portion 66, and engaged portions 67. The holding portion 66 accommodates and removably holds the protrusion 86 of the developer container 8. The engaged portions 67 are engaged with the engaging portions 65 (65A and 65B) in the pull-out operation of the developer container 8, and disengaged from the engaging portions 65 in the pushing operation of the developer container 8 as a result of being brought into contact with disengagement portions 87 (87A and 87B) of the developer container 8 to be elastically deformed.

The holding portion 66 includes a holding frame that extends in the directions D1 and D2 in which the lid 63 moves to open and close the opening. The holding frame has its near-side end discontinuous to serve as a gateway 66*b* for the protrusion 86. The holding frame defines a substantially oblong flat accommodating space 66*a*. The length of the accommodating space 66*a* in the longitudinal direction is, for example, determined in consideration of the positional relationship between the holding portion 66 and the protrusion 86 so that the holding portion 66 does not come into contact with the protrusion 86 when the developer container 8 finishes its movement with respect to the attachment device 6 in the pushing operation of the developer container 8. The size of the gateway 66*b* is determined to be smaller than the width (such as a diameter) of the protrusion 86.

The near-side end portion of the holding portion 66 at which the gateway 66*b* is disposed is spaced apart from the surface of the lid 63 to be elastically deformable and extendable leftward and rightward when the protrusion 86 passes therethrough (refer to FIG. 4 and other drawings). At the near-side end of the holding portion 66 at which the gateway 66*b* is disposed, a pair of tentacles 66*c* linearly extend to open leftward and rightward toward the near side of the holding portion 66.

The pair of tentacles 66*c* are left free without being touched by other portions when the lid 63 is positioned to close the receiving port 62. Thus, the gateway 66*b* is easily elastically deformable to expand outward to the left and right without being prevented from being deformed by the tentacles 66*c*, and allows the protrusion 86 to move into or away from the accommodating space 66*a*. The tentacles 66*c* are left adjacent to or in contact with the inner side wall surfaces of the guide support members 64A and 64B when the lid 63 moves in the opening direction D1 to open the receiving port 62 or is moving in the closing direction D2 to close the receiving port 62.

Thus, the gateway 66*b* is prevented from being deformed by the tentacles 66*c*, prevented from being elastically deformed to expand outward to the left and right, and prevents the protrusion 86 from moving into or away from the accommodating space 66*a*.

Figure 6B:
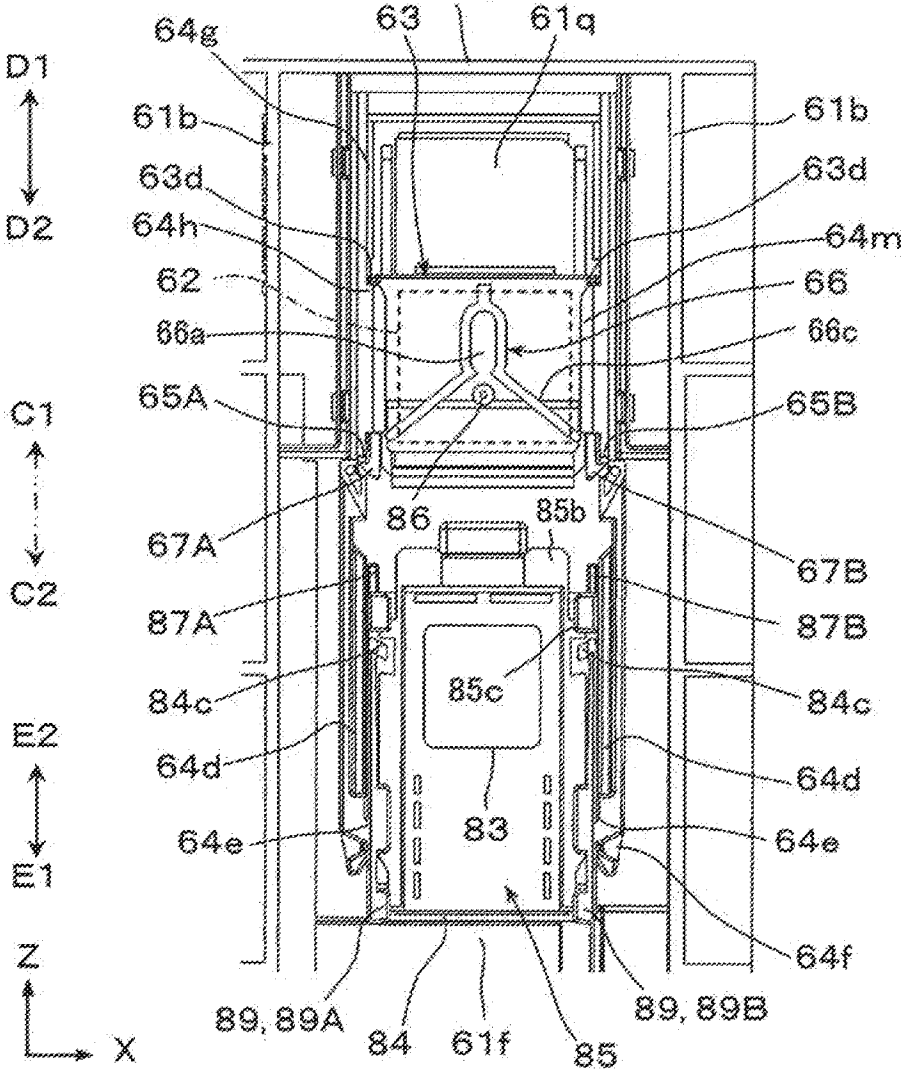
FIG. 6B is a schematic plan view of the state where the lid is positioned to close the receiving port while the developer container is being pulled out of the attachment device.

As illustrated in FIGS. 4A and 4B, FIG. 6B, and other drawings, the engaged portions 67 of the lid 63 correspond to a pair of left and right engaged portions 67A and 67B, which protrude by a predetermined length to the near side (to the side opposite to the side indicated with arrow Z) from the left and right ends of the lid 63 while being spaced apart from each other.

The engaged portions 67A and 67B are formed in a hook shape with their protruding ends respectively bent outward to the left and right.

The engaged portions 67A and 67B are elastically deformable inward when their protruding ends receive a disengagement effect of the disengagement portions 87 of the developer container 8, described below (refer to the dotted arrows in FIG. 10 or FIG. 13).

As illustrated in FIG. 4A, FIG. 6, and other drawings, the lid 63 includes stop protrusions 63*d* at left and right corners on the far side. The stop protrusions 63*d* protrude upward by a predetermined length.

As illustrated in FIG. 6B, when the lid 63 moves in the closing direction D2 to close the receiving port 62, the stop protrusions 63*d* come into contact with the ends 64*h*, which serve as far-side stoppers of the upper support portions 64*m* of the guide support members 64A and 64B, to restrict the further movement in the closing direction D2.

As illustrated in FIG. 4B or FIG. 6B, when the lid 63 is positioned to close the receiving port 62, the lid 63 is stationarily positioned above the receiving port 62 (with the pull-out operation of the developer container 8), and the engaged portions 67A and 67B at the left and right end portions on the near side are kept engaged with the far-side ends 64*h* of the upper support portions 64*m* of the guide support members 64A and 64B.

Thus, the lid 63 is hinders from moving in the opening direction D1 to open the receiving port 62, and thus keeps the receiving port 62 closed.

Figure 6A:
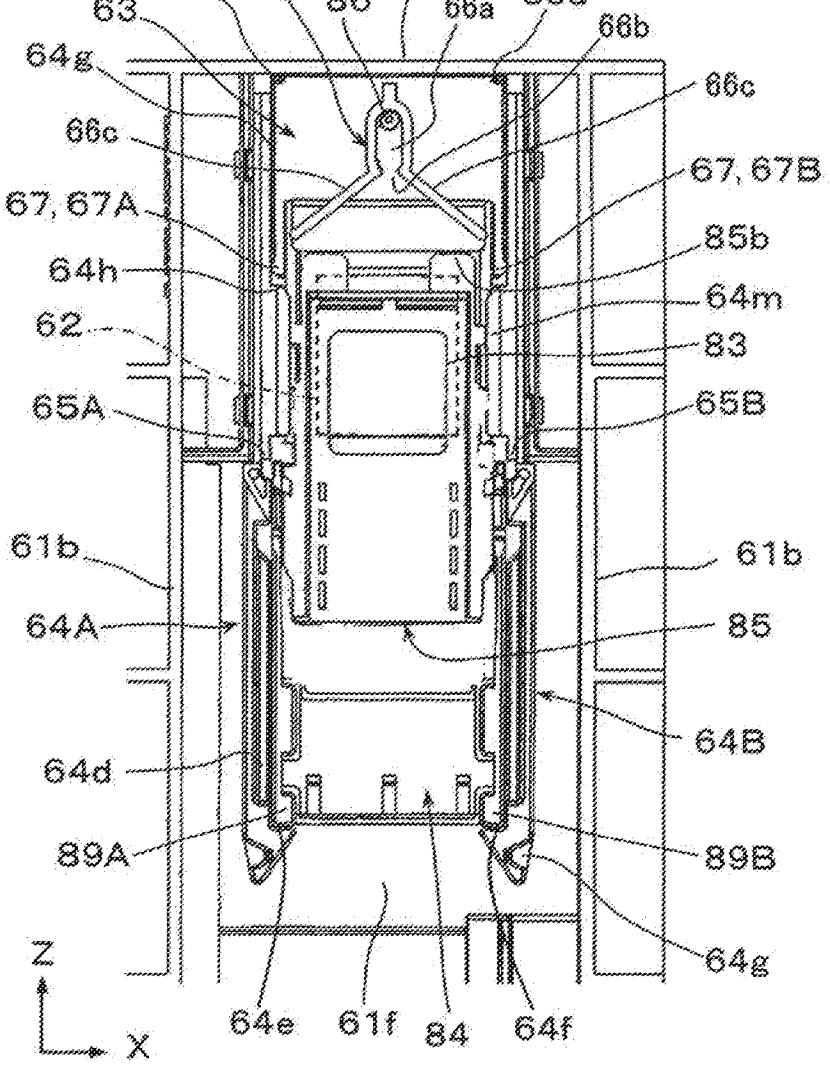
FIG. 6A is a schematic plan view of the state where the developer container is attached to the attachment device and the lid is positioned to open the receiving port.

On the other hand, when the lid 63 is positioned to open the receiving port 62, as illustrated in FIG. 4A or FIG. 6A, the lid 63 is spaced apart from the upper portion of the receiving port 62 to move to the positions of the pair of left and right support portions 64*g* (with the pushing operation of the developer container 8) on the far side of the guide support members 64A and 64B, and left stationary. When the attachment of the developer container 8 is finished, the lid 63 is left stationary with two protruding end portions 85*b* on the far side of a bottom surface portion 85, in which the outlet port of the developer container 8 is formed, in contact with the end portion of the lid 63 on the near side.

Thus, the lid 63 is hindered from moving in the closing direction D2 to close the receiving port 62, and keeps the receiving port 62 open.

Operation of Attaching Developer Container to Attachment Device

The developer container 8 is attached to the attachment device 6 by performing a pushing operation, in which the developer container 8 having its far-side end (end-portion holder 82) serving as a leading end is moved in the direction of arrow C1 from the attachment guide port 61*e* of the side wall portion 61*c* on the near side of the attachment portion 61 of the device body 60.

In this pushing operation, the developer container 8 is pushed toward the far side of the attachment frames 61*b* while the container lid 84 at the far-side end facing downward passes through the passage recess 61*f*, and the guided protrusions 82*d* and 82*e* of the end-portion holder 82 are being guided and supported on the guide steps (guide rails) 61*g* of the attachment frames 61*b* of the attachment portion 61.

Subsequently, in the process of the pushing operation, the disengagement portions 87A and 87B of the container lid 84 of the developer container 8 come into contact with the engaged portions 67A and 67B of the lid 63 of the attachment device 6 (refer to FIG. 10).

Figure 10:
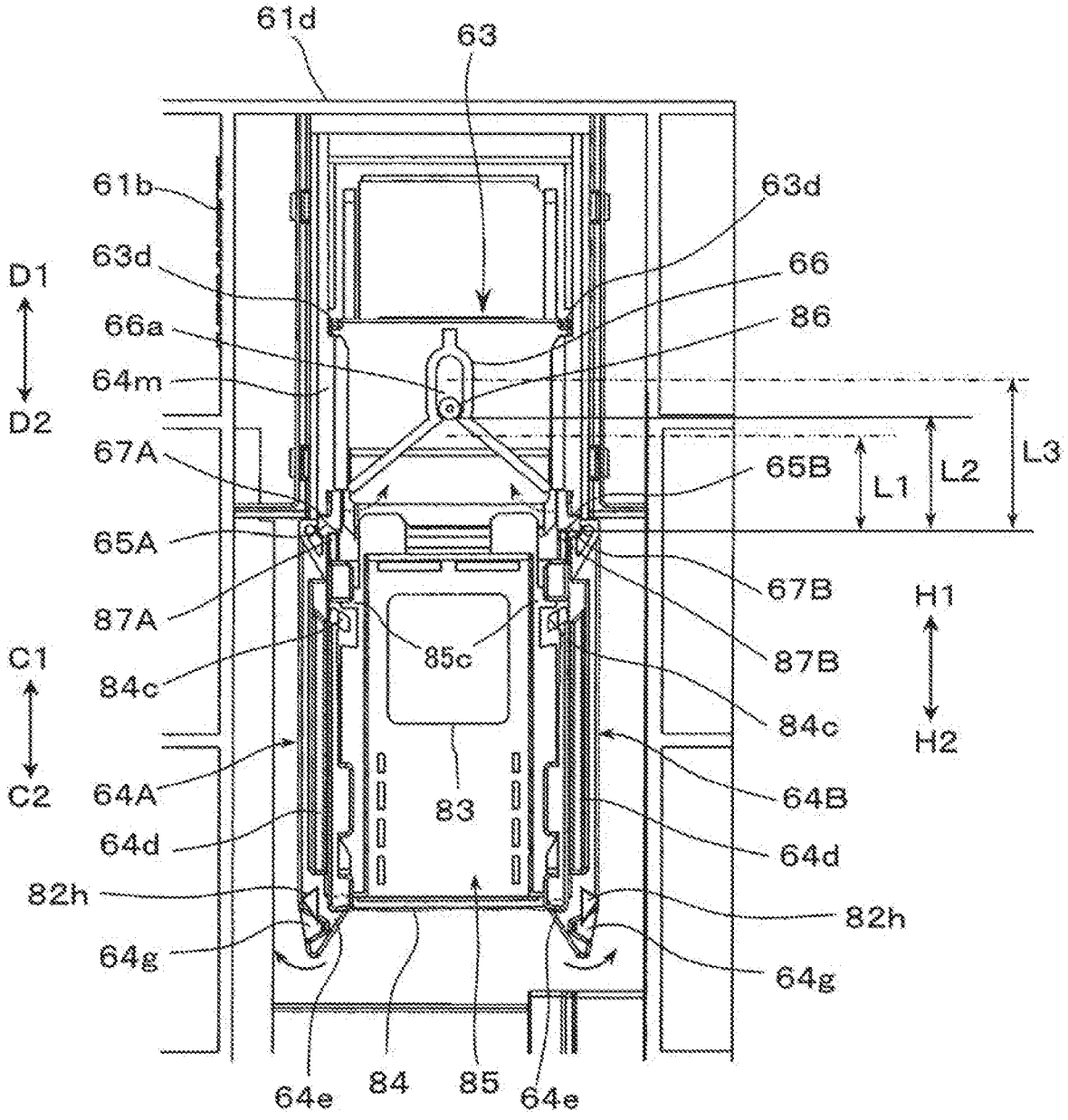
FIG. 10 is a schematic plan view where the lid is positioned to close the receiving port while the developer container is being pulled.
Figure 13:
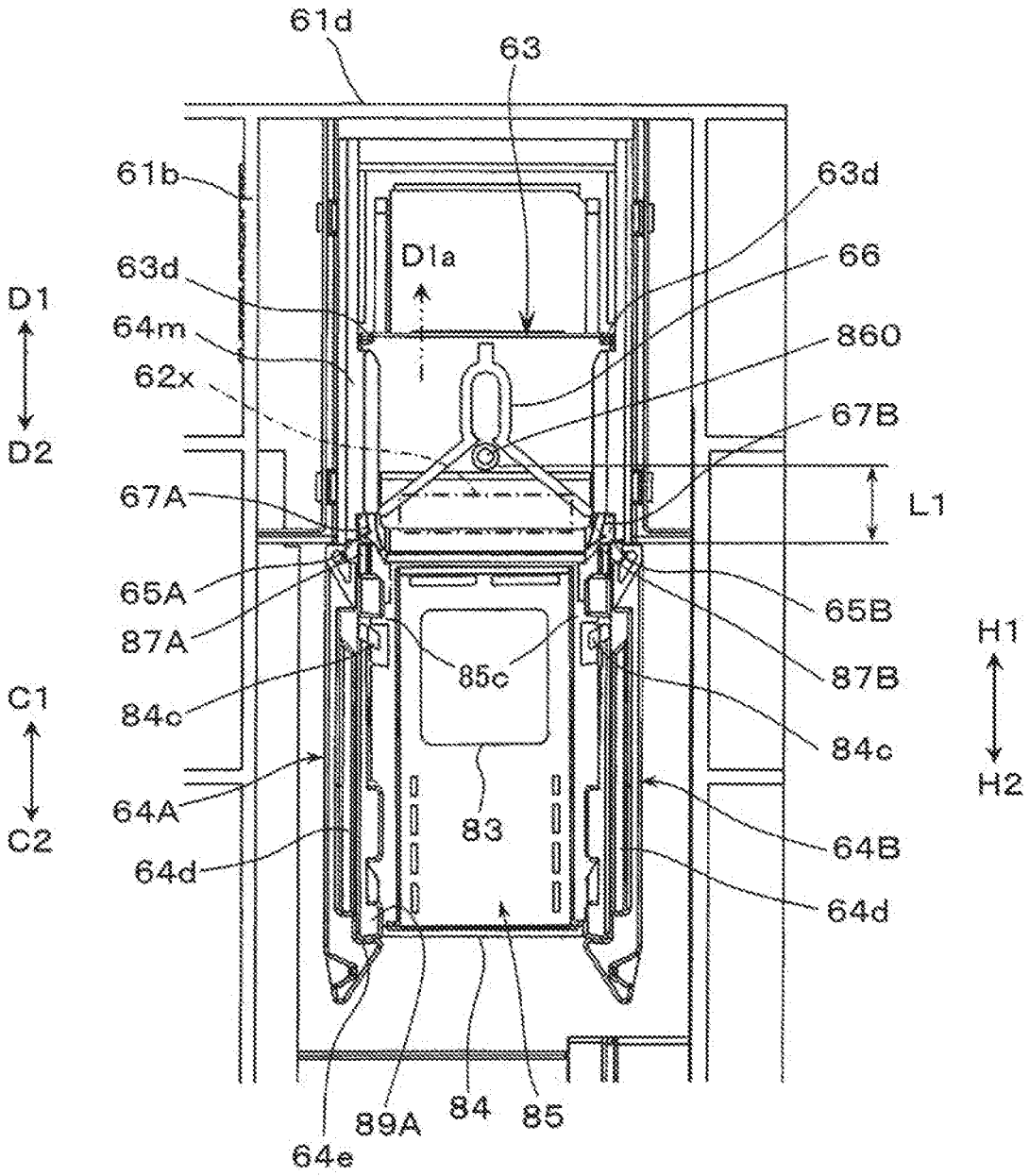
FIG. 13 is a schematic plan view of a defect of a lid that occurs while a developer container according to a comparative example is being pulled out of an attachment portion of an attachment device.

When the developer container 8 is moved further in the movement direction C1 in the pushing operation, the protruding end portions of the disengagement portions 87A and 87B are elastically deformed to bend inward, and disengaged from the engaging portions 65A and 65B (refer to FIG. 10 or FIG. 13).

Here, the protrusion 86 of the end-portion holder 82 of the developer container 8 moves into the accommodating space 66*a* of the holding portion 66 to be accommodated in the accommodating space 66*a* while the gateway 66*b* of the holding portion 66 of the lid 63 is elastically deformed to expand leftward and rightward (refer to FIG. 10).

Subsequently, when the developer container 8 is further moved in the movement direction C1 in the pushing operation, the left and right end portions of the container lid 84 are accommodated in the pair of left and right accommodating holding portions 64*d* on the near side of the guide support members 64A and 64B of the attachment frame 61*b* of the attachment portion 61. Thus, the movement of the container lid 84 with the pushing operation is stopped (refer to FIG. 10).

Thereafter, when the developer container 8 is further moved in the movement direction C1 in the pushing operation, the end-portion holder 82 or the bottom surface portion 85 of the developer container 8 moves in the movement direction C1 while leaving the container lid 84.

During this movement, the two protruding end portions 85*b* on the far side of the bottom surface portion 85 of the developer container 8 are in contact with the end portions of the lid 63 on the near side, and the lid 63 having the engaged portions 67A and 67B disengaged from the engaging portions 65A and 65B is moved into the pair of left and right support portions 64*f* on the far side of the guide support members 64A and 64B to be accommodated therein.

As illustrated in FIG. 6A, when moved into the support portions 64*f*, the engaged portions 67A and 67B of the lid 63 are kept moving while their protruding end portions are elastically deformed to be bent inward and being in contact with the side wall portions of the support portions 64*f* of the guide support members 64A and 64B.

Here, as illustrated in FIG. 6A and other drawings, the lid 63 has its far-side end stopped as a result of being in contact with the side wall portion 61*d* of the containing portion 61 on the far side. The lid 63 at this time is left while allowing the two protruding end portions 85*b* of the bottom surface portion 85 of the developer container 8 being pressed against the end portion of the lid 63 on the near side.

Here, as illustrated in FIG. 6A and other drawings, the protrusion 86 of the developer container 8 is left accommodated in the accommodating space 66*a* of the lid 63.

Here, the coupling, not illustrated, of the end-portion holder 82 of the developer container 8 is coupled with the coupling 61*k* on the side wall portion 61*d* of the containing portion 61 on the far side. The storage, such as a memory, not illustrated, of the end-portion holder 82 is connected to the connection terminal 61*n* of the side wall portion 61*d*. The upper piece of the end-portion holder 82 is held by the stationary holding portion 61*m* of the side wall portion 61*d*.

With the above operation, the developer container 8 is attached to the attachment portion 61 of the attachment device 6.

Here, as illustrated in FIG. 6A and other drawings, in the developer container 8, the container lid 84 is left stationary after being moved in the direction opposite to the movement direction C1 for the pushing operation of the developer container 8 and to the near side E1 of the container body 81 or the end-portion holder 82, and is positioned to open the outlet port of the developer container 8, not illustrated.

As illustrated in FIG. 6A and other drawings, in the attachment device 6, the lid 63 is left stationary on the attachment portion 61 after being moved in a direction D1, which is the same as the movement direction C1 in the pushing operation of the developer container 8, and leaves the receiving port 62 of the attachment portion 61 open.

Removal Operation of Developer Container from Attachment Device

The developer container 8 is removed from the attachment device 6 by performing a pull-out operation, in which the developer container 8 is moved in a direction of arrow C2 through the attachment guide port 61*e* of the side wall portion 61*c* of the attachment portion 61 of the device body 60, while the handle portion 81*d* at the near-side end portion of the container body 81 of the developer container 8 is being held with fingers.

When the pull-out operation is started, the two protruding end portions 85*b* at the bottom surface portion 85 of the developer container 8 are spaced apart from the end portion of the lid 63 on the near side.

Thus, the lid 63 is left movable in the closing direction D2 to close the receiving port 62 within the support portions 64*f* of the guide support members 64A and 64B.

Subsequently, when the developer container 8 is started being moved in the direction of arrow C2 in the pull-out operation, the end-portion holder 82 or the bottom surface portion 85 of the developer container 8 starts moving in the movement direction C2 while the container lid 84 remains stationary.

Here, the protrusion 86 of the developer container 8 accommodated in the accommodating space 66*a* of the holding portion 66 of the lid 63 moves toward and comes into contact with the gateway 66*b* (refer to FIG. 10). Thus, the lid 63 receives the pulling effect from the pull-out operation of the developer container 8 via the protrusion 86, and starts moving in the closing direction D2 to close the receiving port 62.

Subsequently, the bottom surface portion 85 of the developer container 8 becomes engaged with part of the container lid 84.

Specifically, protrusions 85*c* (refer to FIG. 6B, FIG. 8A, and FIG. 10), which protrude outward from the left and right end portions of the bottom surface portion 85 on the far side, come into contact and are engaged with protruding pieces 84*c*, which protrude inward at the left and right end portions of the container lid 84 on the far side, during the movement in the pull-out operation of the developer container 8.

In this stage, the container lid 84 is positioned to close the outlet port of the developer container 8, not illustrated.

Thus, in the developer container 8, the bottom surface portion 85 and the container lid 84 are integrated together. When, in this state, the developer container 8 is further moved in the movement direction C2 in the pull-out operation, the left and right end portions of the container lid 84 are removed from the pair of left and right accommodating holding portions 64*d* on the near side of the guide support members 64A and 64B of the attachment portion 61, and move in the movement direction C2 in interconnection with the movement of the developer container 8.

Subsequently, when the engaged portions 67A and 67B of the lid 63 pass through the near-side end portions of the support portions 64*f* of the guide support members 64A and 64B, the engaged portions 67A and 67B that have been elastically deformed are restored, and their protruding end portions are hooked and engaged on the engaging portions 65A and 65B on the near-side end portions of the upper support portions 64*m* of the support portions 64*f* (refer to FIG. 6B).

In this stage, the lid 63 is positioned to close the receiving port 62 of the attachment portion 61.

Here, the left and right corners 89A and 89B of the container lid 84 that are engaged on the hook-shaped end engagement portions 64*e* disposed on the near-side end portions of the accommodating holding portions 64*d* of the guide support members 64A and 64B are elastically deformed to have the end engagement portions 64*e* bent to open outward to the left and right to be disengaged (refer to FIG. 6B and other drawings). Thus, the left and right corners 89A and 89B of the container lid 84 are allowed to be pulled out from the accommodating holding portions 64*d* of the guide support members 64A and 64B.

The disengagement of the end engagement portions 64*e* is performed by slopes of mountain-shaped deformation guide protruding pieces 82*h* coming into contact with deformation assistance protrusions 64*f* disposed on the upper surfaces of the end engagement portions 64*e*, and by bending and elastically deforming the portions of the end engagement portions 64*e* to open outward to the left and right (directions indicated with solid arrows) (refer to FIG. 10). The deformation guide protruding pieces 82*h* protrude from the bottom of the end-portion holder 82 of the developer container 8.

Thereafter, when the developer container 8 is further moved in the movement direction C2 in the pull-out operation, the developer container 8 is pulled toward the near side of the attachment frame 61*b* while the guided protrusions 82*d* and 82*e* of the end-portion holder 82 are guided and supported on the guide steps 61*g* of the attachment portion 61.

Here, when the protrusion 86 of the developer container 8 is accommodated in the accommodating space 66*a* of the holding portion 66 of the lid 63, the protrusion 86 further moves the lid 63 in the closing direction D2 to close the receiving port 62. However, in this case, the stop protrusions 63*d* at the left and right corners of the lid 63 on the far side come into contact with the far-side ends 64*h* of the upper support portions 64*m* of the support portions 64*g* of the guide support members 64A and 64B, and have their movement restricted. Thus, when the developer container 8 is further moved in the movement direction C2 in the pull-out operation, the lid 63 stays in the support portions 64*g* of the guide support members 64A and 64B without moving.

Finally, the developer container 8 is completely pulled out with the end-portion holder 82 passes through the attachment guide port 61*e* of the side wall portion 61*c* on the near side of the attachment portion 61.

With the above operation, the developer container 8 is removed from the attachment portion 61 of the attachment device 6.

As illustrated in FIG. 6B and other drawings, in the developer container 8, the container lid 84 is moved in the direction opposite to the movement direction C2 in the pull-out operation of the developer container 8 and in a direction E2 toward the far side of the container body 81 or the end-portion holder 82, and left stationary. Thus, the outlet port, not illustrated, in the developer container 8 is left open.

As illustrated in FIG. 6B and other drawings, in the attachment device 6 at this time, the lid 63 is moved in a direction D2 the same as the movement direction C2 in the pull-out operation of the developer container 8, and left stationary on the attachment portion 61. Thus, the receiving port 62 of the attachment portion 61 is left open.

Defects and Countermeasures

Figure 12A:
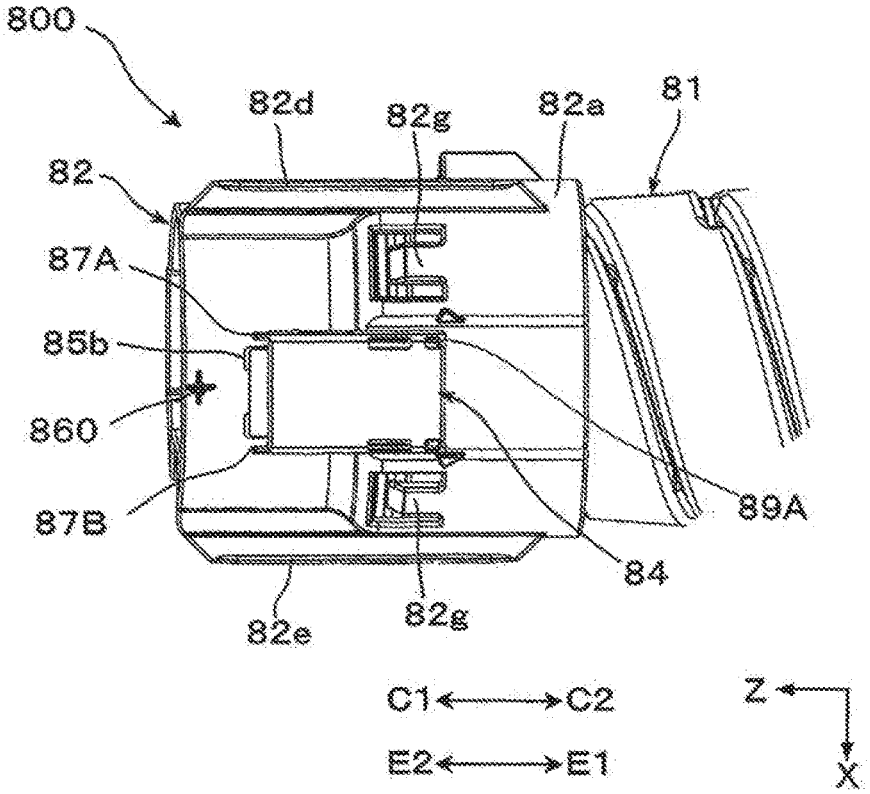
FIGS. 12A and 12B are a bottom view and a side view of a protrusion and a disengagement portion of a developer container according to a comparative example.
Figure 12B:
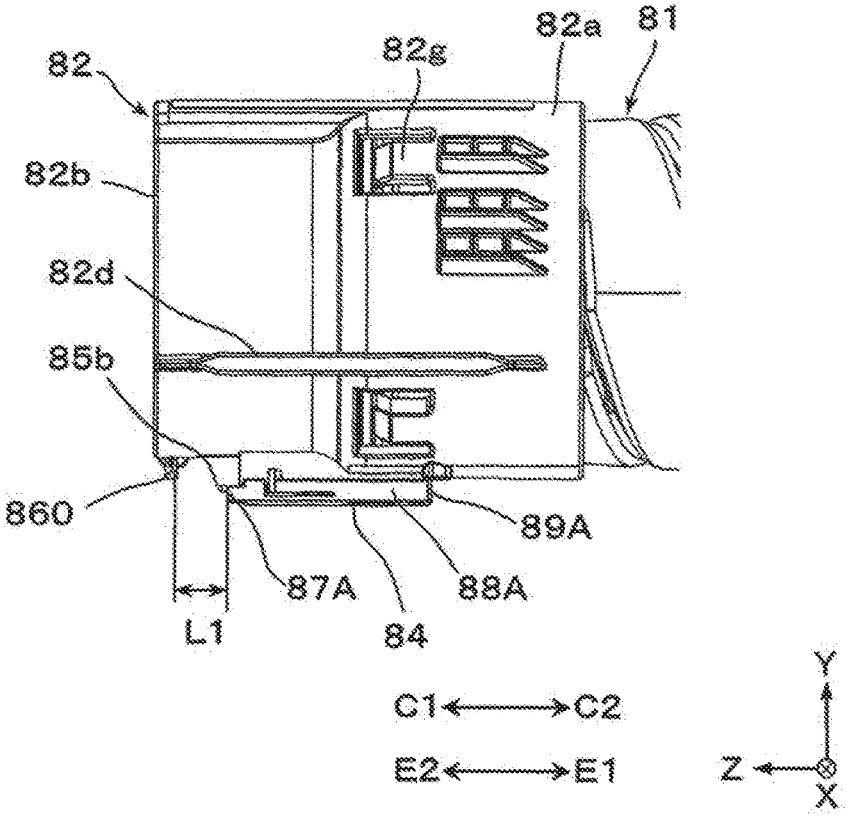

Use of a developer container 800 according to a comparative example as the developer container 8 may cause the following problems. As illustrated in FIG. 12, the developer container 800 has a structure in which a protrusion 860 is fixed to the bottom of the end-portion holder 82, and a distance L between the protrusion 860 and a disengagement portion 87 (87A) of a container lid 84 is a fixed distance (L1).

Specifically, when the developer container 800 is to be removed from the attachment device 6, as illustrated in FIG. 13 by way of example, near-side corners 89 (89A) of the left and right end portions of a container lid 64 of the developer container 800 that has moved in the direction of arrow C2 in the pull-out operation are accommodated in the accommodating holding portions 64*d* of the guide support members 64A and 64B. In this state, the protrusion 860 of the developer container 800 may be pulled out of the accommodating space 66*a* of the holding portion 66 of the lid 63, and the disengagement portions 87A and 87B of the container lid 64 may be in contact with the engaged portions 67A and 67B of the lid 63, and the engaged portions 67A and 67B are disengaged from engaging portions 65A and 65B.

Also in this state, the developer container 800 is further movable in the direction of arrow C2 in the pull-out operation, and finally removed from the attachment device 6.

When such a state occurs, the lid 63 of the attachment device 6 has the engaged portions 67A and 67B disengaged from the engaging portions 65A and 65B. Thus, the lid 63 may thus be pushed back in the direction D1 to open the receiving port 62, so that, as illustrated with a dot-and-dash line in FIG. 13, the lid 63 may be stopped while leaving at least part 62*x* of the receiving port 62 open.

Thus, in the first exemplary embodiment, as illustrated in FIGS. 5 and 7 and other drawings, a member that includes the protrusion 86 movable in a direction away from the disengagement portions 87 in the pull-out operation is used as the developer container 8.

As illustrated in FIG. 5, FIG. 7A to FIG. 9, and other drawings, the developer container 8 includes a slide support portion 91, which slidably supports the protrusion 86 in the movement directions G1 and G2, at the end-portion holder 82, which is one end portion in the longitudinal direction. The protrusion 86 is slidably attached to the slide support portion 91. The direction G1 of arrow G1 is a direction in which the protrusion 86 moves away from the disengagement portions 87. Reference signs 82*j* in FIG. 5 and FIG. 9 denote identification block keys having different patterns for different colors of the developer containers 8, for preventing attachment errors.

As illustrated in FIGS. 7A and 7B and FIGS. 8A to 8C, the protrusion 86 includes a plate-shaped movable body 86*c*, slidably supported by the slide support portion 91, and a cylinder portion 86*a*, which protrudes downward from the plate-shaped movable body 86*c*.

At the base of the cylinder portion 86*a*, a support portion that also reinforces the cylinder portion 86*a* is disposed.

Figure 8A:
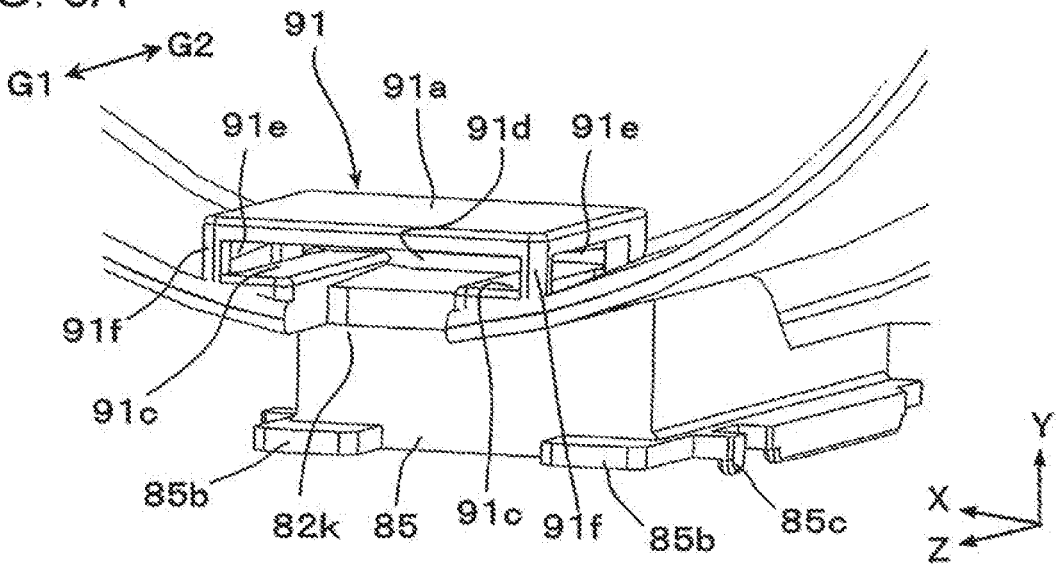
FIG. 8A is a perspective view of a related portion illustrating a structure of a slide support portion of the protrusion in the developer container.
Figure 8B:
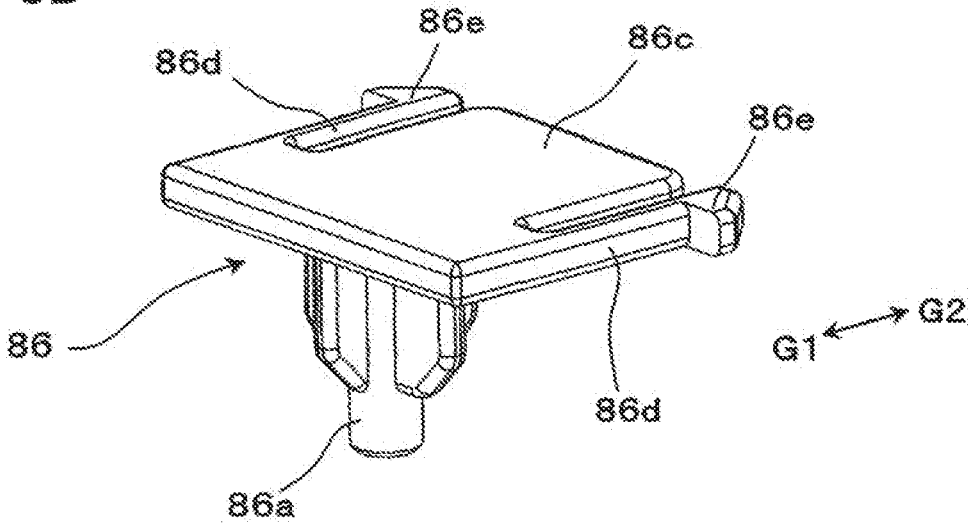
FIG. 8B is a perspective view of the entire structure of the protrusion.

As illustrated in FIG. 8B and other drawings, the movable body 86*c* is formed from a flat member having a substantially rectangular shape in a plan.

Figure 8C:
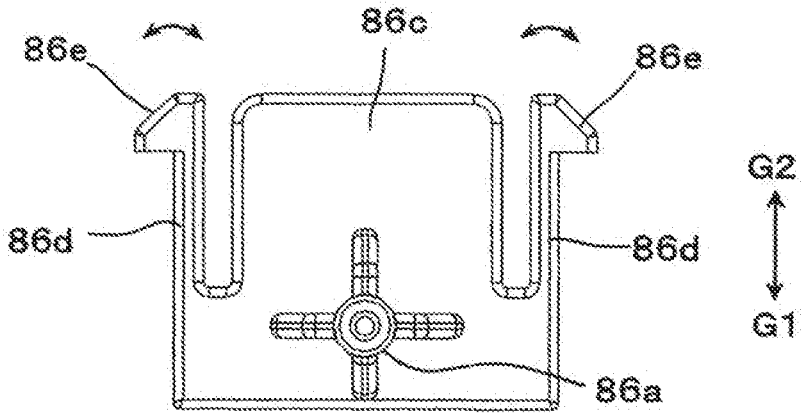
FIG. 8C is an underside view where the protrusion illustrated in FIG. 8B is viewed from below.

As illustrated in FIG. 8B, FIG. 8C, and other drawings, the movable body 86*c* includes snap-fit engagement pieces 86*d*. The engagement pieces 86*d* are disposed on left and right ends (end portions of the attachment device 6 on the near side) supported by the slide support portion 91, extend in a stick shape while being spaced apart from each other, and have their free ends elastically deformable to the left and right (in the directions of both arrows in FIG. 8C). As illustrated in FIG. 8C, the engagement pieces 86*d* include hook-shaped engagement protrusions 86*e* at their free ends. The engagement protrusions 86*e* protrude outward to the left and right beyond the width of the movable body 86*c* during movement.

Figure 7A:
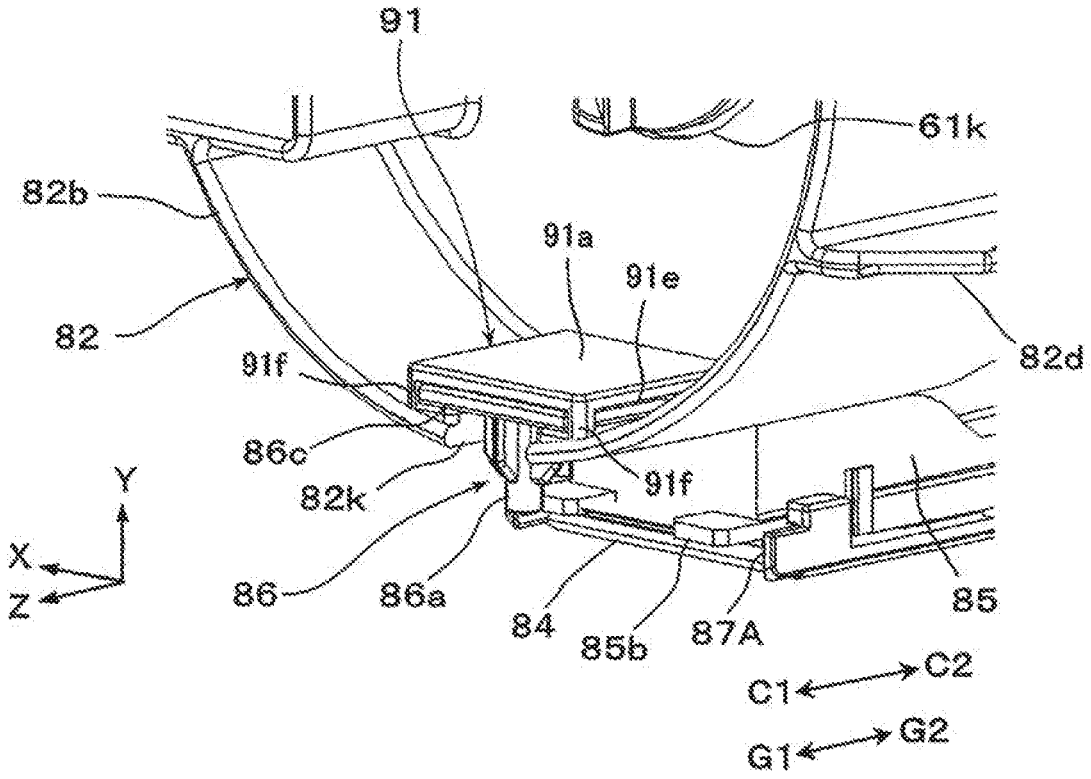
FIG. 7A is a perspective view of a related portion in the state where a protrusion of the developer container is in a retraction position.
Figure 7B:
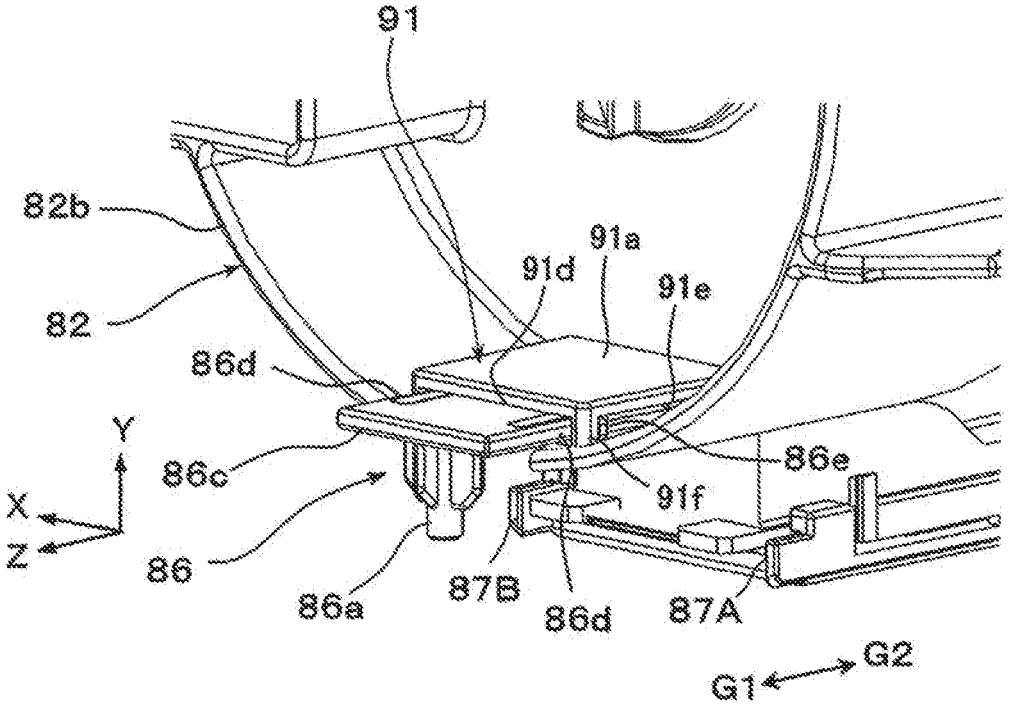
FIG. 7B is a perspective view of the related portion in the state where the protrusion is in a protrusion position.

As illustrated in FIGS. 7A, 7B, and FIG. 8A, the slide support portion 91 is a box-shaped structure disposed on the inner portion of the bottom (inner bottom portion of a flange) at the far-side end 82*b* of the end-portion holder 82. The slide support portion 91 has one end open to support the movable body 86*c* while allowing the movable body 86*c* to move in movement directions G1 and G2 of the protrusion 86.

The slide support portion 91 is a box-shaped structure having an accommodating space defined by, for example, a top portion 91*a* and a bottom surface portion 91*c* to accommodate the entirety of the movable body 86*c*. The top portion 91*a* and the bottom surface portion 91*c* slidably support the movable body 86*c* from above and below. As illustrated in FIG. 5, FIGS. 7A and 7B, FIGS. 8A to 8C, and other drawings, the end-portion holder 82 has a cut 82*k* at the bottom of the far-side end 82*b*. Also using part of the bottom surface portion 91*c* of the slide support portion 91, the cut 82*k* secures the space for accommodating the cylinder portion 86*a* of the protrusion 86 disposed on the bottom surface of the movable body 86*c*.

The slide support portion 91 has an opening 91*d* on a side surface corresponding to the far-side end 82*b* of the end-portion holder 82. The movable body 86*c* moves in and out through the opening 91*d*.

The slide support portion 91 includes slide openings 91*e* symmetrically disposed on the left and right side surfaces. The slide openings 91*e* define the range within which the engagement protrusions 86*e* of the engagement pieces 86*d* of the movable body 86*c* are slidable. At the end portions of the slide openings 91*e* corresponding to the far-side end 82*b* of the end-portion holder 82, columnar stop corners 91*f* are disposed. The stop corners 91*f* define the range within which the protrusion 86 is movable in a direction G1 away from the disengagement portion 87 to restrict the movement of the engagement protrusions 86*e*.

As illustrated in FIGS. 7A and 7B, the protrusion 86 is attached to the slide support portion 91 by inserting the movable body 86*c* into the accommodating space of the slide support portion 91, and by fitting the engagement protrusions 86*e* of the engagement protrusions 86*e* into the slide openings 91*e*.

Thus, the protrusion 86 is supported to be slidable with respect to the slide support portion 91 in the directions of arrows G1 and G2.

As illustrated in FIGS. 7A and 7B, the protrusion 86 is attached to be movable between one end portion of the developer container 8 in the longitudinal direction, or, in this example, a retraction position located to the inner side of the far-side end 82*b* of the end-portion holder 82, and a protrusion position located to the outer side beyond the end portion 82*b*.

The range of movement between the retraction position P1 and the protrusion position P2 is determined as a movable range of the engagement protrusions 86*e* in the slide openings 91*e*.

As illustrated in FIG. 5 or FIG. 7A, the protrusion 86 in the retraction position P1 has its entirety including the movable body 86*c* accommodated in the accommodating space of the slide support portion 91. The protrusion 86 is usually manually moved to the retraction position P1 in an initial stage when, for example, transporting the developer container 8 or pushing the developer container 8 into the attachment device 6 to be completely attached. The protrusion 86 is manually movable to the retraction position P1 by an operator of the developer container 8 also when the protrusion 86 is protruding before being attached to the attachment device 6.

Figure 9:
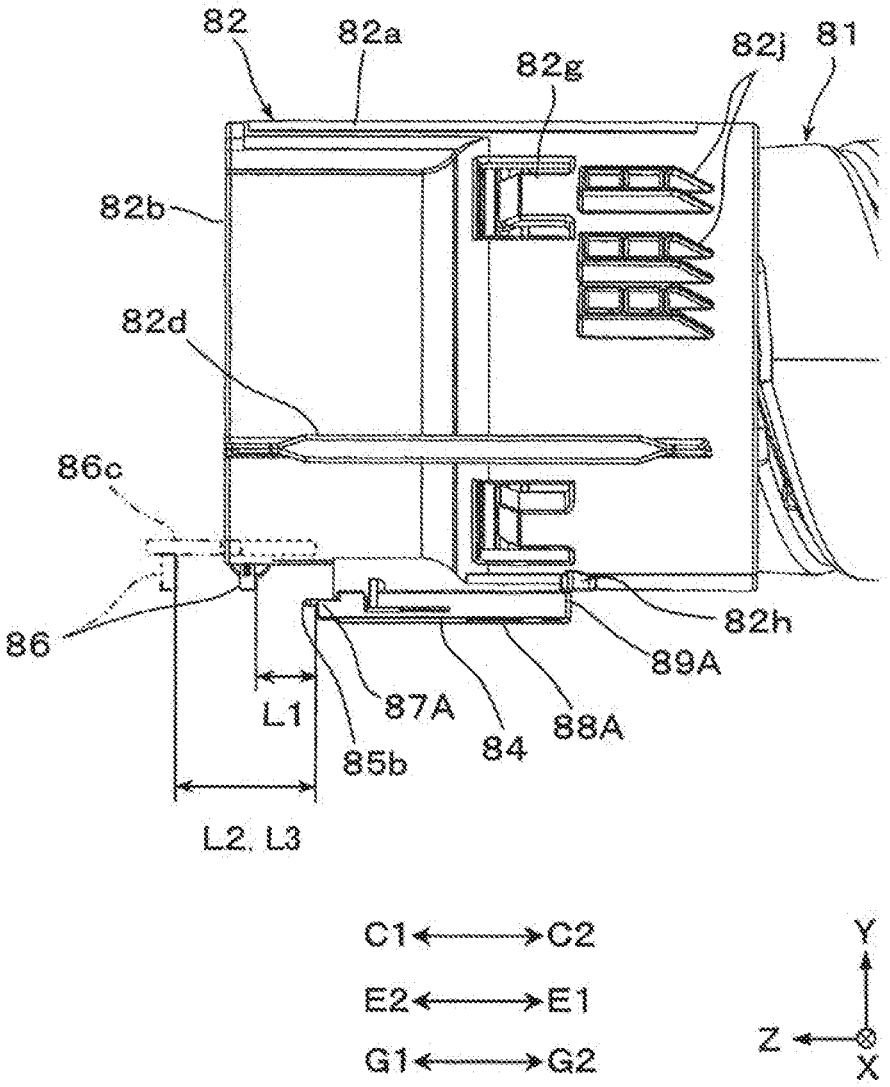
FIG. 9 is a side view of a related portion of the structure of the protrusion of the developer container.

As illustrated in FIG. 5 or FIG. 9 with two-dot chain line, or in FIG. 7B, the protrusion 86 in the protrusion position P2 has a portion including the movable body 86*c* protruding from the accommodating space of the slide support portion 91. When, for example, the developer container 8 is pulled out to be removed from the attachment device 6, the protrusion 86 moves to the protrusion position P2 in the process of the pull-out operation (refer to FIG. 11).

As illustrated in FIG. 7B, the protrusion 86 is stopped in the protrusion position P2 with the engagement protrusions 86*e* of the engagement pieces 86*d* of the movable body 86*c* coming into contact with the stop corners 91*f* and being restricted from moving further.

As illustrated in FIG. 9 or FIG. 10, the protrusion 86 according to the first exemplary embodiment is movable in a direction G1 away from the disengagement portion 87 by a distance L1. The distance L1 secures a length enough for the protrusion 86 to remain accommodated in the holding portion 66 (the accommodating space 66*a* in the holding portion 66) of the lid 63 until the disengagement portions 87A and 87B of the developer container 8 are spaced apart from the engaged portions 67A and 67B of the lid 63 during the pull-out operation of the developer container 8.

In other words, as illustrated in FIG. 9 or FIG. 10, the protrusion 86 is movable in a direction G1 away from the disengagement portions 87 by a distance L2. The distance L2 secures a length enough for the protrusion 86 to remain accommodated in the holding portion 66 of the lid 63 until the disengagement portions 87A and 87B of the developer container 8 are engaged with the engaging portions 65A and 65B of the attachment device 6 during the pull-out operation of the developer container 8.

Here, as illustrated in FIG. 9 or FIG. 10, the distance by which the protrusion 86 is movable in the direction G1 away from the disengagement portions 87 may be a distance L3 longer than the distance L2 (>L2), which is the minimum distance.

When the developer container 8 including the movable protrusion 86 that has been attached to the attachment portion 61 of the attachment device 6 for use is to be pulled out of the attachment portion 61 for removal, the attachment device 6 and the developer container 8 move as follows.

Figures 11A, 11B, 11C:
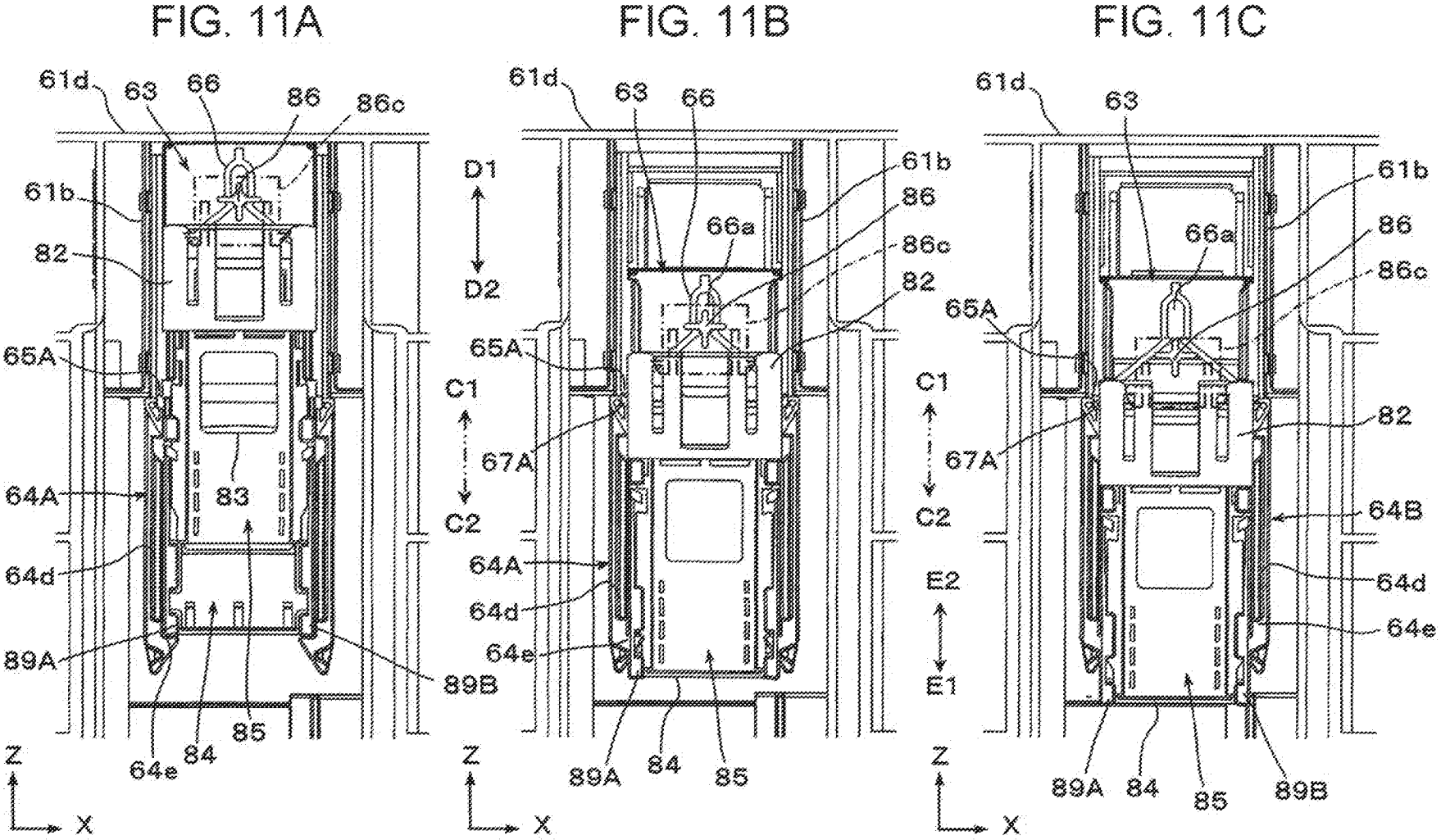
FIGS. 11A, 11B, and 11C are schematic plan views of three states while the developer container is being pulled out of the attachment portion of the attachment device.

Specifically, in the process of pulling the developer container 8 out of the attachment portion 61 of the attachment device 6 in the direction of arrow C2 for removal, as illustrated in FIG. 10 or FIG. 11B, the protrusion 86 of the developer container 8 remains accommodated in at least the accommodating space 66*a* of the holding portion 66 of the lid 63 when the disengagement portions 87A and 87B of the developer container 8 are being spaced apart from the engaged portions 67A and 67B of the lid 63.

In this removal process, as illustrated in FIG. 10 or FIG. 11B, when the disengagement portions 87A and 87B of the developer container 8 are to be engaged with the engaging portions 65A and 65B of the attachment device 6, the protrusion 86 of the developer container 8 remains accommodated in at least the accommodating space 66*a* of the holding portion 66 of the lid 63.

Thus, in the attachment device 6 at this time, as illustrated in FIG. 10, when the pull-out operation of the developer container 8 is continued, the pull-out operation of the developer container 8 transmits the force directed in the direction of arrow C2 to the holding portion 66 of the lid 63 via the protrusion 86 to keep the lid 63 moving in the direction of arrow D2 while the protrusion 86 remains accommodated in the accommodating space 66*a* of the holding portion 66. Thus, the engaged portions 67A and 67B of the lid 63 are retained engaged with the engaging portions 65A and 65B of the attachment portion 61.

Thus, the lid 63 is retained completely moved to the position at which it closes the receiving port 62.

As illustrated in FIG. 6B or FIG. 11C, in the developer container 8 at this time, the near-side corners 89 (89A) of the left and right end portions of the container lid 64 are removed from the accommodating holding portions 64*d* of the guide support members 64A and 64B. Here, as illustrated in FIG. 11C, the developer container 8 is removed from the accommodating space 66*a* of the holding portion 66 of the lid 63 while the protrusion 86 has moved to the protrusion position P2, and the disengagement portions 87A and 87B of the container lid 64 are apart from the engaged portions 67A and 67B of the lid 63 without touching them.

Thus, the developer container 8 is properly removed from the attachment portion 61 of the attachment device 6 with the receiving port 62 being closed as a result of the lid 63 of the attachment device 6 completely moved to the position of closing the receiving port 62.

In the attachment device 6 or the image forming apparatus 1 including the attachment device 6, as described above, to remove the developer container 8 from the attachment device 6 with the pull-out operation, the lid 63 of the attachment portion 61 of the attachment device 6 is completely moved to the position of closing the receiving port 62 of the attachment portion 61.

In the attachment device 6 or the developer container 8, the protrusion 86 is movable to the retraction position P1. Thus, the protrusion 86 moving to the retraction position P1 is prevented from being broken by an accidental contact during transportation or attachment of the developer container 8.

MODIFICATION EXAMPLE

The present disclosure is not limited to the contents illustrated in the first exemplary embodiment by way of example, and includes, for example, modification examples, below.

The structure of moving the protrusion 86 of the developer container 8 is not limited to a slide support structure according to the first exemplary embodiment, and may have another movement structure.

Instead of the developer container 8, the present disclosure is also applicable to a powder container that accommodates other powder.

A powder container installable in a powder-container attachment device (6), such as the developer container 8, will suffice as long as it has at least the following structure. Specifically, the powder container includes a protrusion 86, facing part of the lid 63 at a portion capable of approaching the lid 63 in the pushing operation, and disengagement portions 87, which are disposed on the rear of the protrusion 86 to disengage the engaging portions 65. The protrusion 86 is movable in a direction G1 away from the disengagement portions 87 in the pull-out operation.

Examples usable as the image forming apparatus 1 include those having different forms or types. Examples usable as the attachment device 6 include an attachment device that allows a powder container accommodating powder other than a developer to be attached thereto.

The foregoing description of the exemplary embodiments of the present disclosure has been provided for the purposes of illustration and description. It is not intended to be exhaustive or to limit the disclosure to the precise forms disclosed. Obviously, many modifications and variations will be apparent to practitioners skilled in the art. The embodiments were chosen and described in order to best explain the principles of the disclosure and its practical applications, thereby enabling others skilled in the art to understand the disclosure for various embodiments and with the various modifications as are suited to the particular use contemplated. It is intended that the scope of the disclosure be defined by the following claims and their equivalents.

What is claimed is:

1. A powder-container attachment device, comprising:

a powder container configured to accommodate powder; and a device body comprising:

an attachment portion to and from which the powder container is attached attachable and removable with a pushing operation and a pull-out operation;

a receiving port configured to receive powder fed from the powder container attached to the attachment portion;

a lid that is moved movable in interconnection with the pushing operation and the pull-out operation of the powder container in an opening direction and a closing direction to open and close the receiving port; and an engaging portion configured to engage with the lid a state of closing the receiving port, wherein the powder container comprises:

a protrusion that faces part of the lid, and that is disposed at a portion capable of approaching the lid during the pushing operation; and a disengagement portion that is disposed on a rear of the protrusion to disengage the engaging portion, wherein the lid comprises:

a holding portion configured to accommodate the protrusion to removably hold the protrusion, and an engaged portion that is configured to engage with the engaging portion during the pull-out operation, and that is elastically deformable by contact with the disengagement portion during the pushing operation to be disengaged from the engaging portion, and wherein the powder container is movable in a direction in which the protrusion moves away from the disengagement portion during the pull-out operation.

2. The powder-container attachment device according to claim 1, wherein the protrusion is configured to move by a distance that secures a length enough for the protrusion to remain accommodated in the holding portion until the protrusion disengagement portion is spaced apart from the engaged portion during the pull-out operation.

3. The powder-container attachment device according to claim 2, wherein the protrusion is configured to move by a distance that secures a length enough for the protrusion to remain accommodated in the holding portion until the engaged portion is engaged with the engaging portion during the pull-out operation.

4. The powder-container attachment device according to claim 3, wherein the protrusion is configured to move between a retraction position, located on an inner side of an end portion of the powder container in a longitudinal direction, and a protrusion position, protruding to an outer side beyond the end portion.

5. The powder-container attachment device according to claim 4, wherein the protrusion is stopped at the protrusion position.

6. The powder-container attachment device according to claim 3, wherein the powder container includes a slide support portion, which supports the protrusion to allow the protrusion to slide, at an end portion in a longitudinal direction of the powder container, and wherein the protrusion is attached to be slidable along the slide support portion.

7. The powder-container attachment device according to claim 2, wherein the protrusion is configured to move between a retraction position, located on an inner side of an end portion of the powder container in a longitudinal direction, and a protrusion position, protruding to an outer side beyond the end portion.

8. The powder-container attachment device according to claim 7, wherein the protrusion is stopped at the protrusion position.

9. The powder-container attachment device according to claim 2, wherein the powder container includes a slide support portion, which supports the protrusion to allow the protrusion to slide, at an end portion in a longitudinal direction of the powder container, and wherein the protrusion is attached to be slidable along the slide support portion.

10. The powder-container attachment device according to claim 1, wherein the protrusion is configured to move by a distance that secures a length enough for the protrusion to remain accommodated in the holding portion until the engaged portion is engaged with the engaging portion during the pull-out operation.

11. The powder-container attachment device according to claim 10, wherein the protrusion is configured to move between a retraction position, located on an inner side of an end portion of the powder container in a longitudinal direction, and a protrusion position, protruding to an outer side beyond the end portion.

12. The powder-container attachment device according to claim 11, wherein the protrusion is stopped at the protrusion position.

13. The powder-container attachment device according to claim 10, wherein the powder container includes a slide support portion, which supports the protrusion to allow the protrusion to slide, at an end portion in a longitudinal direction of the powder container, and wherein the protrusion is attached to be slidable along the slide support portion.

14. The powder-container attachment device according to claim 1, wherein the protrusion is configured to move between a retraction position, located on an inner side of an end portion of the powder container in a longitudinal direction, and a protrusion position, protruding to an outer side beyond the end portion.

15. The powder-container attachment device according to claim 14, wherein the powder container includes a slide support portion, which supports the protrusion to allow the protrusion to slide, at an end portion in a longitudinal direction of the powder container, and wherein the protrusion is attached to be slidable along the slide support portion.

16. The powder-container attachment device according to claim 14, wherein the protrusion is stopped at the protrusion position.

17. The powder-container attachment device according to claim 1, wherein the powder container includes a slide support portion, which supports the protrusion to allow the protrusion to slide, at an end portion in a longitudinal direction of the powder container, and wherein the protrusion is attached to be slidable along the slide support portion.

18. The powder-container attachment device according to claim 17, wherein the protrusion is disposed on a movable body slidably supported by the slide support portion, and wherein the movable body includes a locking portion that is configured to lock on a portion of the slide support portion to restrict a movement of the movable body after the movable body moves a predetermined distance in a direction away from the disengagement portion.

19. An image forming apparatus, comprising the powder-container attachment device according to claim 1.

20. A powder container that is installable in the powder-container attachment device according to claim 1.

* * * * *